US012140029B1

(12) United States Patent
Lipoma

(10) Patent No.: US 12,140,029 B1
(45) Date of Patent: Nov. 12, 2024

(54) HIGH PRESSURE FLUID JET DRILL SYSTEM

(71) Applicant: Dig Energy, Inc., Manchester, NH (US)

(72) Inventor: Thomas Lipoma, Hopkinton, NH (US)

(73) Assignee: Dig Energy, Inc., Manchester, NH (US)

( * ) Notice: Subject to any disclaimer, the term of this patent is extended or adjusted under 35 U.S.C. 154(b) by 0 days.

(21) Appl. No.: 18/377,616

(22) Filed: Oct. 6, 2023

(51) Int. Cl.
*E21B 7/18* (2006.01)
*E21B 10/60* (2006.01)
*E21B 43/29* (2006.01)

(52) U.S. Cl.
CPC ..... *E21B 7/18* (2013.01); *E21B 10/60* (2013.01); *E21B 43/29* (2013.01)

(58) Field of Classification Search
CPC ..... E21B 7/18; E21B 10/60; E21B 43/29
See application file for complete search history.

(56) References Cited

U.S. PATENT DOCUMENTS 6,289,998 B1 * 9/2001 Krueger ..... E21B 7/18 175/25
2016/0258232 A1 9/2016 Harper

* cited by examiner

*Primary Examiner* — Yong-Suk (Phillip) Ro
(74) *Attorney, Agent, or Firm* — Foley Hoag LLP; Hathaway P. Russell; Stephen J. Kenny

(57) ABSTRACT

A high pressure fluid drill head system for boring holes in both residential and non-residential areas for geothermal energy shafts. The high pressure drill head system having a body sized for the intended borehole to be drilled and including a plurality of parts coupled together via one or more fastening methods. The plurality of parts including an outflow channel within the body, a piston, at least one high pressure flow channel disposed within the body, the high pressure flow channel disposed parallel to the outflow channel, a nozzle in fluid communication with the high pressure flow channel, the nozzle having at least one orifice configured for ejecting a fluid, and a return feed inlet disposed at the lower end of the body, the return feed inlet in fluid communication with the outflow channel.

19 Claims, 20 Drawing Sheets

128

1100

1112

1116

HIGH PRESSURE FLUID JET DRILL SYSTEM

BACKGROUND OF THE DISCLOSED SUBJECT MATTER

Field of the Disclosed Subject Matter

The disclosed subject matter relates to fluid jet drill system. Particularly, the present disclosed subject matter is directed to a fluid (e.g. water) jet negative pressure drill head. This disclosure relates to drilling systems and geothermal energy capture/production systems and, in particular, a low cost system for producing and installing a complete geothermal direct energy generation system.

DESCRIPTION OF RELATED ART

There are methods for drilling. These processes are usually fluid intensive and chemically introductive and they add time, money, and contamination to the operation.

Because of the typically high cost of drilling operations, almost all existing geothermal power generation is limited to large, high efficiency systems that require extremely large upfront capital investment and must be installed in locations that have an abnormally high subsurface temperature gradient. Conventional drilling systems require large diameter boreholes, with excessive drilling forces (e.g. torque) that often over pressurize the borehole.

In addition, while the demand for renewable energy sources is increasing, geothermal energy is not currently able to meet that demand because of the high cost and limited availability of installation sites. Further, because geothermal heat flux is distributed over the entire surface of the earth, only a small amount of energy can be sourced from any one location before the subsurface rock starts to cool down.

There thus remains a need for an efficient and economic method and system for water jet drill heads as described herein.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a system for a high pressure fluid drill head including a body having an upper end and a lower end, the body having an outflow channel disposed at an axial center extending from the upper end to the lower end, a piston disposed coaxially with the outflow channel within the body, the piston having a top end proximate the upper end of the body and a bottom end proximate the lower end of the body, at least one high pressure flow channel disposed within the body, the high pressure flow channel disposed parallel to the outflow channel, a nozzle in fluid communication with the high pressure flow channel, the nozzle having at least one orifice configured for ejecting a fluid, a return feed inlet disposed at the lower end of the body, the return feed inlet in fluid communication with the outflow channel.

To achieve these and other advantages and in accordance with the purpose of the disclosed subject matter, as embodied and broadly described, the disclosed subject matter includes a system for a high pressure fluid drill head including a body having an upper end and a lower end, defining a conical sidewall disposed therebetween, the conical sidewall extending along a central axis, the body having an outflow channel extending within the body from the first end along the central axis, a piston disposed coaxially with the outflow channel within the body, the piston having a top end proximate the upper end of the body and a bottom end proximate the lower end of the body, at least one high pressure flow channel disposed within the body, the high pressure flow channel disposed parallel to the outflow channel, a nozzle in fluid communication with the high pressure flow channel, the nozzle having at least one orifice configured for ejecting a fluid, a return feed inlet disposed on the conical sidewall and extending to the outflow channel at an angle to the central axis, the return feed inlet in fluid communication with the outflow channel.

To achieve these and other advantages and in accordance with the purpose of the disclosed subject matter, as embodied and broadly described, the disclosed subject matter includes a system for a high pressure fluid jet drill head including a body, the body having a first circular end and a second circular end, defining cylindrical continuous sidewall therebetween, the cylindrical sidewall extending parallel to a central axis, a conical recess disposed within the body, the conical recess extending inwardly along the central axis from the second circular end to an internal apex, wherein the internal apex has a lesser diameter than the second circular end, a high pressure fluid inlet disposed within the body proximate the first circular end, at least one nozzle in fluid communication with the high pressure fluid inlet, the at least one nozzle having an orifice disposed proximate the internal apex of the conical recess.

To achieve these and other advantages and in accordance with the purpose of the disclosed subject matter, as embodied and broadly described, the disclosed subject matter includes a system for a high pressure fluid jet drill head including a body have a first circular end and a second circular end, wherein the circular end has a lesser diameter than the first circular end, a conical surface extending from the first circular end and the second circular end, a central fluid inlet disposed within the body proximate the first circular end and extending along a central axis toward the second circular end, and at least one nozzle in fluid communication with the central fluid inlet, the at least one nozzle disposed on the conical surface.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

BRIEF DESCRIPTION OF THE DRAWINGS

A detailed description of various aspects, features, and embodiments of the subject matter described herein is provided with reference to the accompanying drawings, which are briefly described below. The drawings are illustrative and are not necessarily drawn to scale, with some components and features being exaggerated for clarity. The drawings illustrate various aspects and features of the present subject matter and may illustrate one or more embodiment(s) or example(s) of the present subject matter in whole or in part.

DETAILED DESCRIPTION OF AN EXEMPLARY EMBODIMENT

Reference will now be made in detail to exemplary embodiments of the disclosed subject matter, an example of which is illustrated in the accompanying drawings. The method and corresponding steps of the disclosed subject matter will be described in conjunction with the detailed description of the system.

Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

As used herein, the term "exemplary" is used in the sense of "example," rather than "ideal." Moreover, the terms "a" and "an" herein do not denote a limitation of quantity, but rather denote the presence of one or more of the referenced items.

Figure 1:
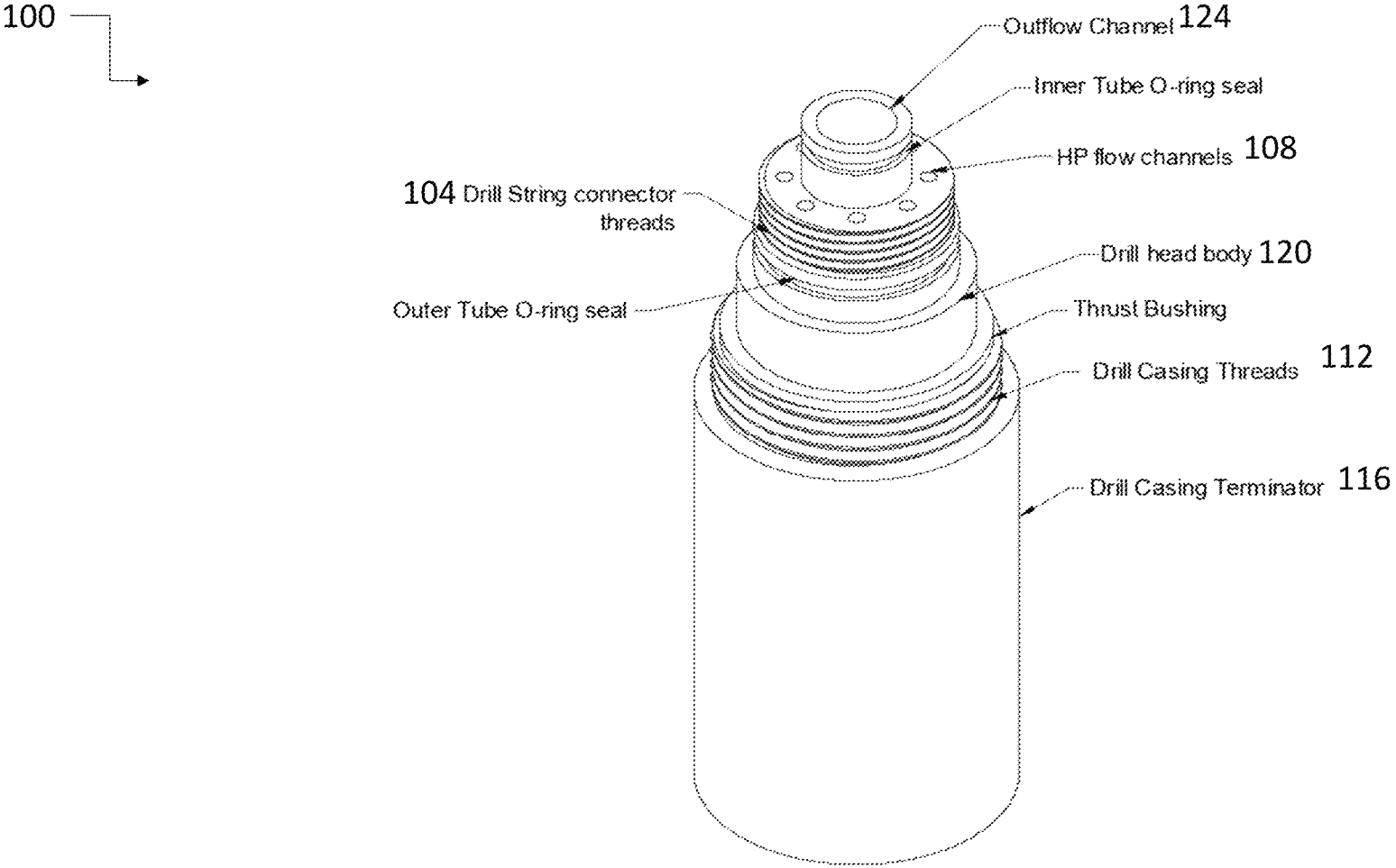
FIG. 1 is a schematic representation of a high pressure fluid drill head shown in isometric view.

The methods and systems presented herein may be used for drilling bore holes in the earth. The disclosed subject matter is particularly suited for drilling bore holes in both residential and non-residential areas for geothermal energy shafts. For purposes of explanation and illustration, and not limitation, an exemplary embodiment of the system in accordance with the disclosed subject matter is shown in FIG. 1 and is designated generally by reference character 100. Similar reference numerals (differentiated by the leading numeral) may be provided among the various views and Figures presented herein to denote functionally corresponding, but not necessarily identical structures.

Referring now to FIG. 1, a schematic representation of a high pressure fluid drill head 100 is shown in isometric view. Drill head 100 may be generally cylindrical in construction (with varying diameters along its length), with the cutting action occurring within the cylindrical casing or "skirt" 116 that extends distally beyond the fluid-ejecting nozzles which effect the cutting (as described in more detail below). Drill head 100 may be formed from one integral component, wherein any and all internal voids or cavities are machine or additively formed in the manufacture of drill head 100. In various embodiments, drill 100 may include a plurality of parts and portions coupled together via one or more fastening methods such as threads, bolts, screws, or the like. Drill head 100 may include a connecting portion configured to couple the drill head to one or more preceding components, such as fluid connections, pumps, filters, actuators or the like. Drill head 100 may include drill string connector threads 104 configured to connect drill head 100 to one or more preceding components, the entire assembly or a subset of that assembly may be referred to as the drill string.

Drill head 100 may include a generally cylindrical construction, the cylindrical construction may be sized based on intended borehole to be drilled. Drill head 100 may be formed with a generally cylindrical construction aligned with the vertical axis, or any axis parallel to the borehole intended to be drilled by drill head 100. Drill head 100 may be formed with a radially symmetrical cross section. Drill head 100 may be formed with a square cross section, triangle cross section, pentagonal, hexagonal, heptagonal, octagonal or higher number of equally spaced and symmetrical sides. For example and without limitation, one or more ports may be disposed in one or more sides of the drill head 100.

Drill head 100 may be formed from one or more metals or metal alloys such as tungsten or tungsten carbide. For example and without limitation, drill head 100 may be formed from aluminum, aluminum alloys, steel alloys such as stainless steel or high carbon steel. Drill head 100 may be formed from a non-metallic material, as the drill head 100, in embodiments, need not directly contact the target material. In various embodiments, drill 100 may be formed from a high-density plastic such as high-density polyethylene (HDPE). In various embodiments, at least a portion of the drill head 100 may be formed from a first material, and a second portion of drill head 100 may be formed from a second material. For example and without limitation, the fluid lines or cavities in which fluid flows through drill head 100 may be formed from a metal such as copper or aluminum such as to stand up to the high pressure fluid. The remainder of drill head 100 may be formed from a high-density plastic configured to save weight and maneuverability.

With continued reference to FIG. 1, drill head 100 includes high pressure flow channels 108. There may be as many channels, fluid lines, or components configured to feed high pressure fluid to one or more nozzles as required. For example and without limitation, there may be as many high pressure flow channels 108 and one or more other optional channels, which will be described in greater detail below. For example there may be four nozzles and high pressure flow channels 108 equally and radially spaced about a central axis, each nozzle spraying towards central axis; though alternative numbers of channels are within the scope of the present disclosure. The high pressure flow channels can be configured as discrete separate channels at select axial/longitudinal locations (e.g. as evidenced by the circumferentially spaced orifices shown in FIG. 1), with some/all of these channels merging to be in fluid communication with a single/common source of upstream fluid (e.g. water) for cutting, as described in further detail below. Also, each of these high pressure fluid channels 108 can have a dedicated/single path of fluid travel (e.g. from proximal end to distal end to be dispensed and perform the cutting operation).

Drill head 100 may include radiused corners, throttles, bottle necks and the like configured to provide the high pressure fluid without losses in pressure and wear on the equipment. In various embodiments, drill head 100 is configured to intake high pressure fluid through high pressure flow channel(s) 108 continuously, in steps, parts, bursts and/or pulses. In various embodiments, high pressure flow channel 108 may be interchangeable within drill head 100, such as being disposed in a removable portion of drill head 100 of through one or more access ports. In various embodiments, wherein high pressure flow channel 108 is a recess or machined channel, there may be access ports in drill head 100 to allow access or maintenance to the inlet. In the exemplary embodiment shown in 1, the high pressure flow channels 108 may be oriented radially about the central axis of the drill head 100, the drill head 100 having a plurality of distinct and cylindrical channels. In various embodiments, flow channel 108 may include one or more filters disposed therein. The one or more filters may be partially of fully annular and may be disposed at any point along flow channel 108. For example and without limitation, the one or more filters may be disposed where two components meet and are threaded together, thereby providing compression to hold the filter in place within flow channel 108. In various embodiments, the radial tension of the filter may secure the filter within flow channel 108. In operation, high pressure fluid (e.g. water) is delivered through any vertical or horizontal bore and "turns", e.g. 90°, to enter one or more nozzles, ports, channels, or the like for ejection to drill the desired substrate.

With continued reference to FIG. 1, drill head 100 includes drill casing threads 112, with an outer cylindrical wall connected underneath thereto, the outer cylindrical wall being a drill casing terminator 116. Drill casing threads 112 may connect the drill head 100 to one or more components in the drill string, the drill string having a continuous outer wall extending upward from drill casing terminator 116. Drill casing terminator 116 may have a outer diameter similar to the intended borehole diameter to be formed by the drill head 100 in operation. In various embodiments, drill head 100 may have an outer diameter that is configured to substantially form a seal against the borehole it creates. In various embodiments, drill case terminator 116 may be configured to rotate relative to the drill head body 120. In various embodiments, the drill head body 120 may be rotatably connected to the drill casing terminator 116 and any other component described. For example and without limitation, drill head body 120 may be configured to rotate, oscillate, translate, or otherwise move relative to drill casing terminator 116. Any components described herein may have a seal formed therebetween. In various embodiments, any seal formed within drill head 100 or components thereof may be formed via rubber gaskets or O-rings. The gaskets and O-rings may be sized according to the components they are sealing and/or formed to sit within slots or body features of the components it is in physical contact with. In various embodiments, gaskets and O-rings may be configured to operate within the temperature and pressure regimes in which the components it seals against are operating in.

Figure 2A:
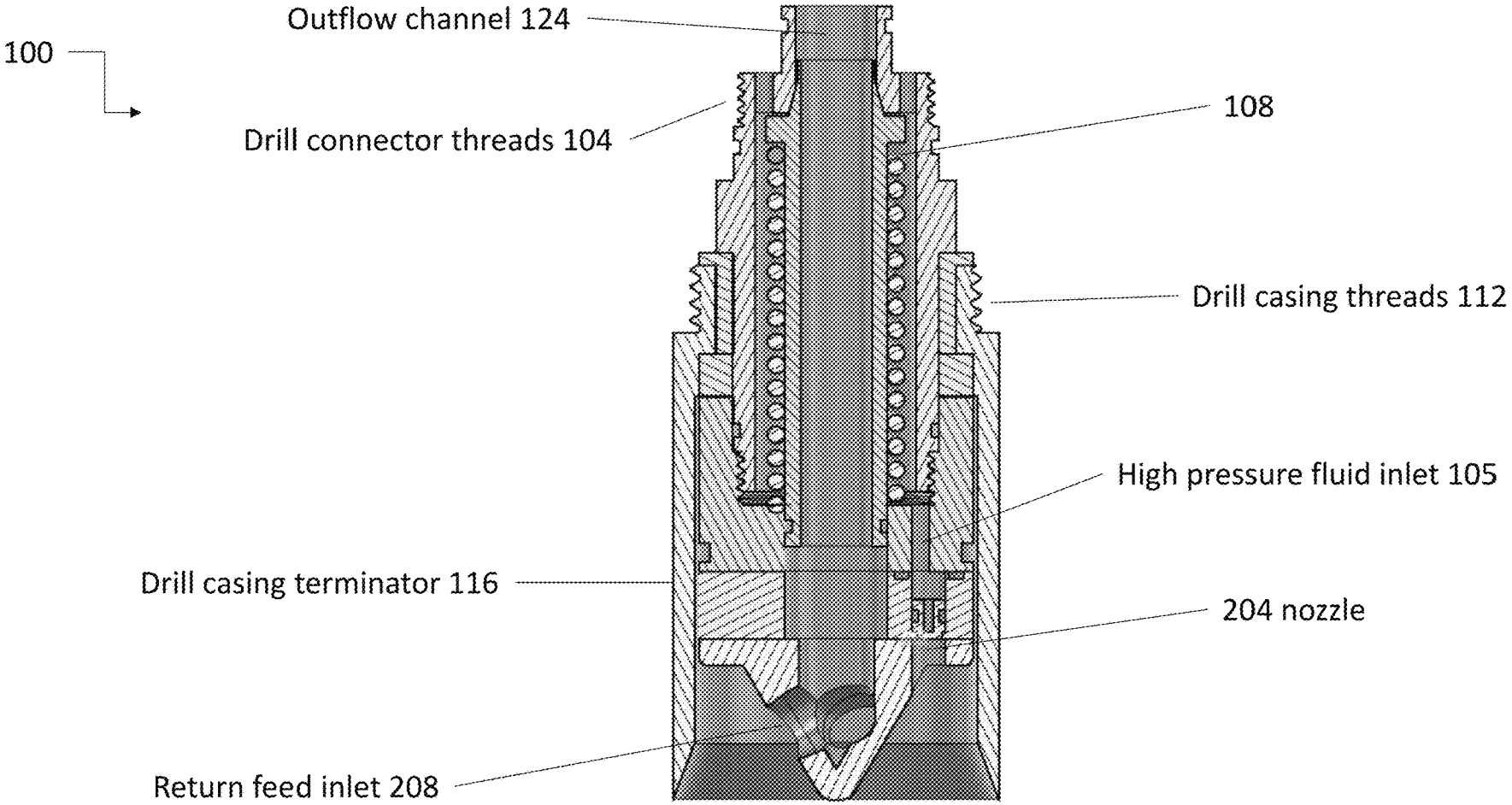
FIG. 2A is a schematic representation of a high pressure fluid drill head shown in section view.

Referring now to FIG. 2A, a schematic representation of a high pressure fluid drill head 100 is shown in section view. Drill head 100 is substantially the same as shown in FIG. 1. Drill head 100 includes an outflow channel 124. Outflow channel 124 may be centrally and longitudinally extending through the radial center of the drill head 100. In various embodiments, outflow channel 124 may be a cylindrical and radially symmetrical channel extending unobstructed through the drill head 100. In various embodiments, outflow channel 124 may be off-center. In various embodiments, outflow channel 124 may be branched, having secondary or further channels extending therefrom. In various embodiments, outflow channel 124 may have one or more openings formed within the cylindrical wall at various points extending through the drill head 100. In various embodiments, outflow channel 124 may be disposed at an angle to the longitudinal axis of drill head 100. In various embodiments, outflow channel 124 may have one or more chokepoints, bottles necks, or variable diameter sections therein. The outflow channel can have a dedicated/single path of fluid travel that is opposite the high pressure flow channel(s) 108—for example, from distal end to proximal end to excavate the debris (or "cuttings") removed during cutting. Also, the diameter of the outflow channel 124 can be larger than each high pressure flow channel(s) 108 (e.g., in some embodiments the diameter of outflow channel 124 is approximately equal to the aggregate/sum of diameters of the high pressure channels 108).

In accordance with an aspect of this disclosure wherein the cutting fluid lows around the outside of the drill string (but within the drill casing 116), and fluid returns (with debris/cuttings) through the center of the drill string is advantageous in that it:

i. reduces the amount of volume required for a given flow velocity,
ii. increases the rock (or debris) diameter that can pass through outflow channel 124 for a lower volume;
iii. reduces the required borehole diameter;
iv. allows for drilling fluid to pass unobstructed through all the components of the drill system;
v. allows for smaller components which can fit inside the borehole; and
vi. provides cheaper and simpler components.

In various embodiments, outflow channel 124 may terminate/originate at a bottom portion of drill head 100 in one or more return feed inlets 208. In various embodiments, return feed inlet 208 may be a single inlet disposed at the radial center of the bottom portion of drill head 100. In various embodiments, return feed inlet 208 may be more than one opening radially symmetrically about the longitudinal axis of drill head 100. In various embodiments, return feed inlet 208 may be configured to intake rocks and earth that have been pulverized by the drill head and brought up the outflow channel 124 towards the surface of the borehole. In various embodiments, outflow channel 124 may be subjected to a negative pressure from one or more fluids moving in another component of drill head 100. In various embodiments, return feed inlet 208 may be circular openings disposed at an angle relative to the longitudinal axis of drill head 100. In various embodiments, return feed inlet 208 may be set at 30, 45 or 60 degrees from the longitudinal axis. In various embodiments, return feed inlet 208 may be disposed parallel to the bottom of the borehole such that the openings are perpendicularly disposed to the longitudinal axis of the drill head 100. In various embodiments, a drill inlet portion having the return feed inlets 208 may attach to the bottom of the drill head 100 and filters material so large objects do enter the return stream going up and through the outflow channel 124. In various embodiments, the return feed inlet 208 may be smaller in diameter than outflow channel 124, thus anything that passes through return feed inlet 208 may pass through outflow channel 124 without becoming stuck and hinder flow.

With continued reference to FIG. 2A, drill head 100 includes one or more nozzles 204 where fluid is dispensed to cut/advance the borehole. In this embodiment, a drill head 100 is provided which has one or more nozzles that connect to one or more high pressure fluid passages 108. As pressure is generated inside of the drill head, high velocity fluid streams are forced through the nozzles (which can rotate, or be rotated statically with the drill head 100) and directed at the substrate. When the high velocity fluid streams meet with the substrate, the kinetic energy is converted into a high pressure region which fractures/cuts the substrate surface. In a related embodiment, the drill head could have one nozzle pointing a single fluid stream at an angle which crosses the center axis of the drilling direction (as shown in FIG. 4B), this can be advantageous since the reduction in number of nozzles likewise reduces the power needed to operate the system. Additionally or alternatively, the drill head may have multiple nozzles along the surface of a cone pointing tangentially or near tangentially to the cone's surface. Each of the multiple nozzles may be supplied with individual sources of high pressure fluid or may connect to a central high pressure source passing through the central axis of the cone.

The nozzle 204 converts the high pressure fluid into a high velocity stream along a straight trajectory. In various embodiments, nozzle 204 may convert the high pressure fluid into a high velocity stream along multiple straight trajectories. In various embodiments, nozzle 204 may convert the high pressure fluid into a high velocity stream for each of a plurality of orifices disposed in nozzle 204. For example and without limitation, nozzle 204 may have two orifices configured to convert the high pressure fluid into a high velocity stream along two parallel trajectories. In various embodiments, drill head 100 may include more than one nozzle 204, each similar to the nozzle in FIG. 1, but spaced radially about the drill head 100. For example and without limitation, a second nozzle 204 may be symmetrically and oppositely spaced from the nozzle shown in FIG. 1, such as to provide a second high velocity stream in a mirrored trajectory.

In various embodiments, the fluid utilized to provide the high velocity stream may be water. In various embodiments, the fluid utilized to provide the high velocity stream may be a chemical compound. In various embodiments, the fluid utilized to provide the high velocity stream may be a solution including a particulate suspended in a medium, such as water. In various embodiments, the fluid utilized to provide the high velocity stream may be of a variable temperature, ranging from above freezing temperatures to near boiling temperatures. In various embodiments, each of the components that contact the fluid may be treated to resist rust and/or contamination from any chemical or particulate present in the fluid.

Figure 2C:
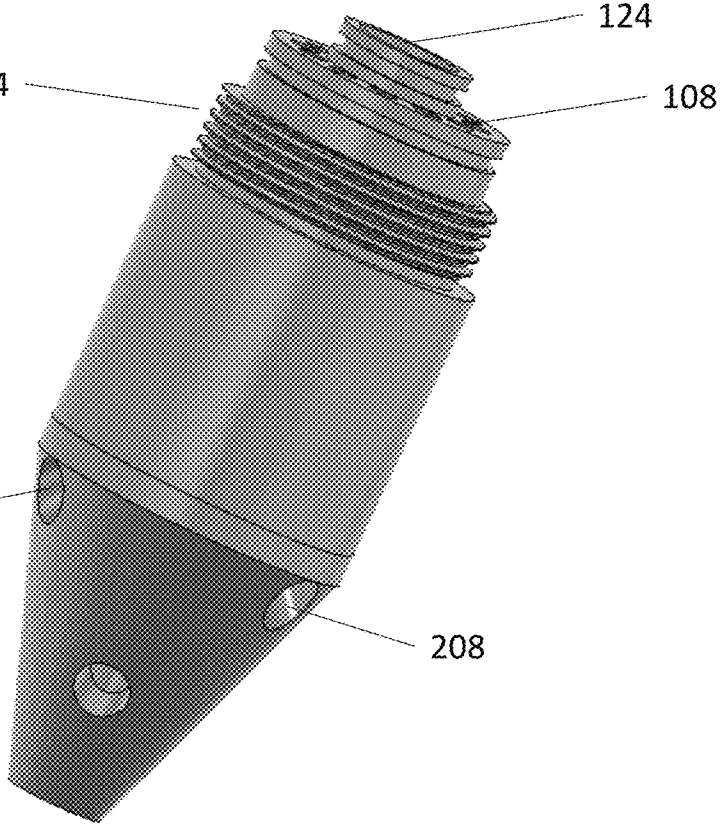
FIGS. 2B-2C are schematic representations of a high pressure fluid drill head shown in perspective views.
Figure 2B:
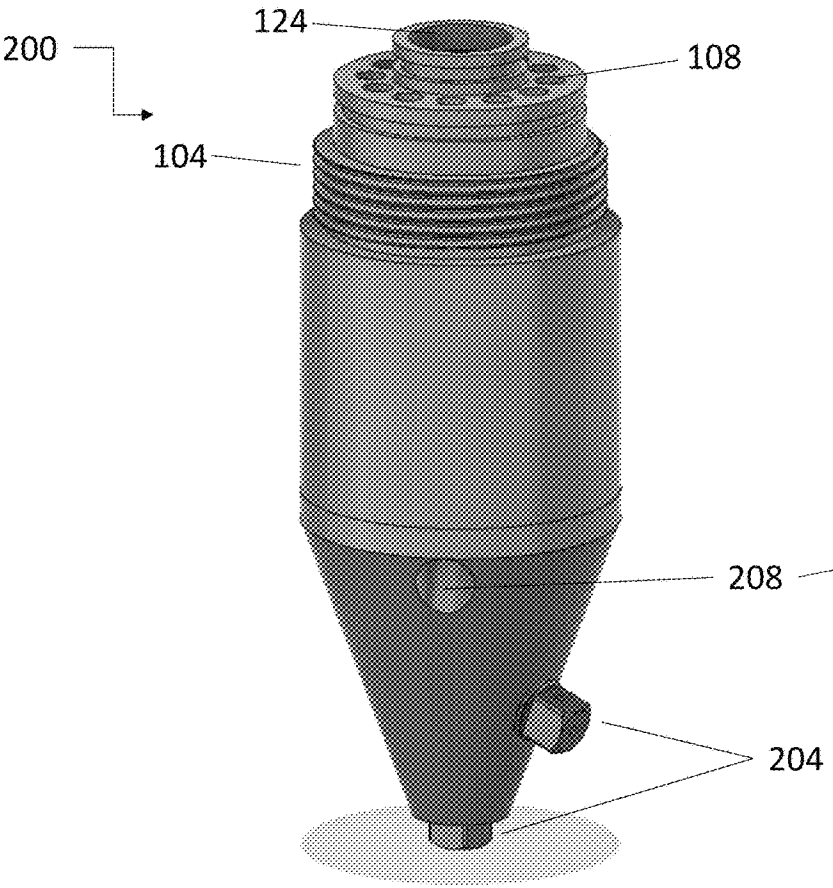

Referring now to FIGS. 2B-2C, a schematic representation of a high pressure fluid drill head 200 is shown in perspective views. Drill head 200 may be generally cylindrical in construction (with varying diameters along its length), with the cutting action occurring at the conical surface extending distally from the cylindrical drill body. Drill head 200 may be formed as an inverted cone, with the apex of the conical surface disposed downward and configured to be at the bottom of the borehole proximate the cutting action. The apex of the cone of the drill head 200 may be configured to push unbroken large cuttings out of the way to allow downward progress in target materials above bedrock. In situations below bedrock, the inverted cone drill head 200 may be configured to hold unbroken large cuttings in the area where the fluid jets are ejected from the nozzles (which are disposed on the conical surface) which aids in breaking down or cutting the large cuttings further to be removed through outflow channel 124.

Drill head 200 may be formed from one integral component, wherein any and all internal voids or cavities are machine or additively formed in the manufacture of drill head 200. In various embodiments, drill head 200 may include a plurality of parts and portions coupled together via one or more fastening methods such as threads, bolts, screws, or the like. Drill head 200 may include a connecting portion configured to couple the drill head to one or more preceding components, such as fluid connections, pumps, filters, actuators or the like. Drill head 200 may include drill string connector threads 104 configured to connect drill head 200 to one or more preceding components, the entire assembly or a subset of that assembly may be referred to as the drill string.

Drill head 200 may include a generally cylindrical construction, the cylindrical construction may be sized based on intended borehole to be drilled. Drill head 200 may be formed with a generally cylindrical construction aligned with the vertical axis, or any axis parallel to the borehole intended to be drilled by drill head 200. Drill head 200 may be formed with a radially symmetrical cross section. Drill head 200 may be formed with a square cross section, triangle cross section, pentagonal, hexagonal, heptagonal, octagonal or higher number of equally spaced and symmetrical sides. For example and without limitation, one or more ports may be disposed in one or more sides of the drill head 200.

Drill head 200 may be formed from one or more metals or metal alloys such as tungsten or tungsten carbide. For example and without limitation, drill head 200 may be formed from aluminum, aluminum alloys, steel alloys such as stainless steel or high carbon steel. Drill head 200 may be formed from a non-metallic material, as the drill head 200, in embodiments, need not directly contact the target material. In various embodiments, drill 200 may be formed from a high-density plastic such as high-density polyethylene (HDPE). In various embodiments, at least a portion of the drill head 100 may be formed from a first material, and a second portion of drill head 200 may be formed from a second material. For example and without limitation, the fluid lines or cavities in which fluid flows through drill head 200 may be formed from a metal such as copper or aluminum such as to stand up to the high pressure fluid. The remainder of drill head 100 may be formed from a high-density plastic configured to save weight and maneuverability.

With continued reference to FIG. 2B-2C, drill head 200 includes high pressure flow channels 108. There may be as many channels, fluid lines, or components configured to feed high pressure fluid to one or more nozzles as required. For example and without limitation, there may be as many high pressure flow channels 108 and one or more other optional channels, which will be described in greater detail below. For example there may be four nozzles and high pressure flow channels 108 equally and radially spaced about a central axis, each nozzle spraying towards central axis; though alternative numbers of channels are within the scope of the present disclosure. The high pressure flow channels can be configured as discrete separate channels at select axial/longitudinal locations (e.g. as evidenced by the circumferentially spaced orifices shown in FIGS. 2B-2C), with some/all of these channels merging to be in fluid communication with a single/common source of upstream fluid (e.g. water) for cutting, as described in further detail below. Also, each of these high pressure fluid channels 108 can have a dedicated/single path of fluid travel (e.g. from proximal end to distal end to be dispensed and perform the cutting operation).

Drill head 200 may include radiused corners, throttles, bottle necks and the like configured to provide the high pressure fluid without losses in pressure and wear on the equipment. In various embodiments, drill head 200 is configured to intake high pressure fluid through high pressure flow channel(s) 108 continuously, in steps, parts, bursts and/or pulses. In various embodiments, high pressure flow channel 108 may be interchangeable within drill head 200, such as being disposed in a removable portion of drill head 200 of through one or more access ports. In various embodiments, wherein high pressure flow channel 108 is a recess or machined channel, there may be access ports in drill head 200 to allow access or maintenance to the inlet. In the exemplary embodiment shown in 1, the high pressure flow channels 108 may be oriented radially about the central axis of the drill head 200, the drill head 200 having a plurality of distinct and cylindrical channels. In various embodiments, flow channel 108 may include one or more filters disposed therein. The one or more filters may be partially of fully annular and may be disposed at any point along flow channel 108. For example and without limitation, the one or more filters may be disposed where two components meet and are threaded together, thereby providing compression to hold the filter in place within flow channel 108. In various embodiments, the radial tension of the filter may secure the filter within flow channel 108. In operation, high pressure fluid (e.g. water) is delivered through any vertical or horizontal bore and "turns", e.g. 90°, to enter one or more nozzles, ports, channels, or the like for ejection to drill the desired substrate.

With continued reference to FIGS. 2B-2C, a schematic representation of a high pressure fluid drill head 200 is shown in section view. Drill head 200 may be similar to FIGS. 1-2A. Drill head 200 includes an outflow channel 124. Outflow channel 124 may be centrally and longitudinally extending through the radial center of the drill head 200. In various embodiments, outflow channel 124 may be a cylindrical and radially symmetrical channel extending unobstructed through the drill head 200. In various embodiments, outflow channel 124 may be off-center. In various embodiments, outflow channel 124 may be branched, having secondary or further channels extending therefrom. In various embodiments, outflow channel 124 may have one or more openings formed within the cylindrical wall at various points extending through the drill head 200. In various embodiments, outflow channel 124 may be disposed at an angle to the longitudinal axis of drill head 100. In various embodiments, outflow channel 124 may have one or more choke-points, bottles necks, or variable diameter sections therein. The outflow channel can have a dedicated/single path of fluid travel that is opposite the high pressure flow channel(s) 108—for example, from distal end to proximal end to excavate the debris (or "cuttings") removed during cutting. Also, the diameter of the outflow channel 124 can be larger than each high pressure flow channel(s) 108 (e.g., in some embodiments the diameter of outflow channel 124 is approximately equal to the aggregate/sum of diameters of the high pressure channels 108).

In accordance with an aspect of this disclosure wherein the cutting fluid lows around the outside of the drill string through high pressure flow channel 108 and fluid returns (with debris/cuttings) through the center of the drill string in outflow channel 124.

In various embodiments, outflow channel 124 may terminate/originate at a conical surface portion of drill head 200 in one or more return feed inlets 208. In various embodiments, return feed inlet 208 may be a single inlet disposed about the conical surface of drill head 200, as shown in FIG. 2C. In various embodiments, return feed inlet 208 may be more than one opening radially symmetrically about the longitudinal axis of drill head 200. In various embodiments, return feed inlet 208 may be configured to intake cuttings and earth that have been pulverized by the drill head and brought up the outflow channel 124 towards the surface of the borehole. In various embodiments, outflow channel 124 may be subjected to a negative pressure from one or more fluids moving in another component of drill head 200. In various embodiments, return feed inlet 208 may be circular openings disposed at an angle relative to the longitudinal axis of drill head 200. In various embodiments, return feed inlet 208 may be set at 30, 45 or 60 degrees from the longitudinal axis. In various embodiments, return feed inlet 208 may be disposed parallel to the bottom of the borehole such that the openings are perpendicularly disposed to the longitudinal axis of the drill head 200. In various embodiments, a drill inlet portion having the return feed inlets 208 may attach to the bottom of the drill head 200 and filters material so large objects do enter the return stream going up and through the outflow channel 124. In various embodiments, the return feed inlet 208 may be smaller in diameter than outflow channel 124, thus anything that passes through return feed inlet 208 may pass through outflow channel 124 without becoming stuck and hinder flow.

With continued reference to FIG. 2B-2C, drill head 200 may include one or more nozzles 204 where fluid is dispensed to cut/advance the borehole. In this embodiment, a drill head 200 is provided which has more than one nozzle that connect to one or more high pressure fluid passages 108. As pressure is generated inside of the drill head, high velocity fluid streams are forced through the nozzles (which can rotate, or be rotated statically with the drill head 200) and directed at the substrate. When the high velocity fluid streams meet with the substrate, the kinetic energy is converted into a high pressure region which fractures/cuts the substrate surface. In a related embodiment, the drill head could have one nozzle pointing a single fluid stream at an angle which crosses the center axis of the drilling direction (as shown in FIG. 4B), this can be advantageous since the reduction in number of nozzles likewise reduces the power needed to operate the system. Additionally or alternatively, the drill head may have multiple nozzles along the surface of the cone pointing tangentially or near tangentially to the cone's surface. Each of the multiple nozzles may be supplied with individual sources of high pressure fluid or may connect to a central high pressure source passing through the central axis of the cone as shown in FIGS. 2B-2C.

Figure 2D:
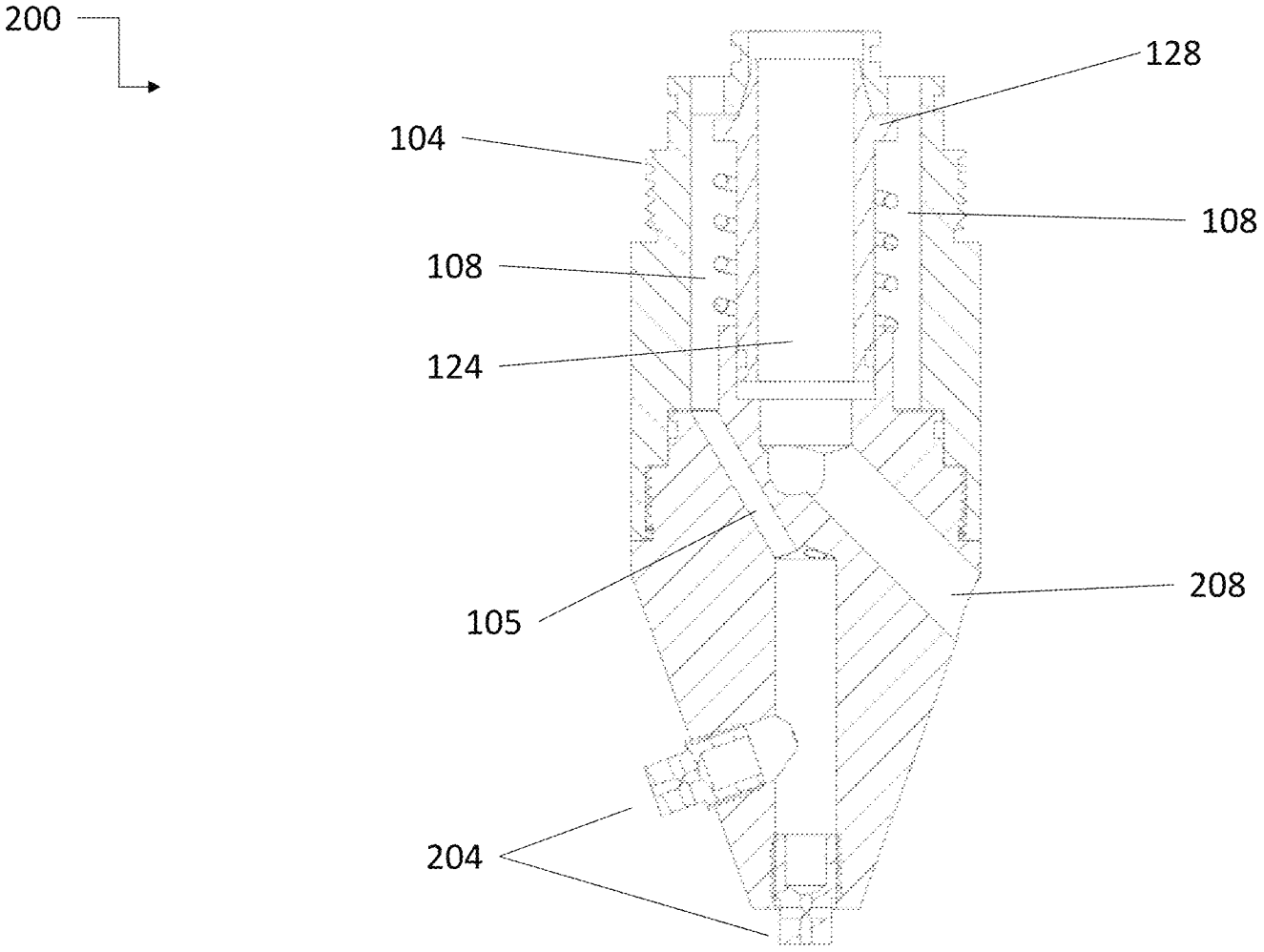
FIG. 2D is a schematic representation of a high pressure fluid drill head shown in section view.

The nozzle 204 converts the high pressure fluid into a high velocity stream along a straight trajectory. In various embodiments, nozzle 204 may convert the high pressure fluid into a high velocity stream along multiple straight trajectories. In various embodiments, nozzle 204 may convert the high pressure fluid into a high velocity stream for each of a plurality of orifices disposed in nozzle 204. For example, and without limitation, nozzle 204 may have two orifices configured to convert the high pressure fluid into a high velocity stream along two parallel trajectories. In various embodiments, drill head 100 may include more than one nozzle 204, such as one nozzle disposed on the conical surface of the drill head 200 and one nozzle disposed at the point of the cone at the lowest portion of the drill head 200. For example, and without limitation, a second nozzle 204 may be disposed on the conical surface with orifices oriented parallel to the conical surface and perpendicular to the conical surface. The nozzle at the point of the cone may have an orifice disposed longitudinally along the axis of the cone, dispensing fluid downward. In various embodiments, the nozzles 204 may be fed by the same high pressure fluid inlet 105. In various embodiments, the nozzles 204 may be fed by individual high pressure fluid inlets that flow together into a distribution channel in fluid communication with the nozzles. In various embodiments, as shown in FIGS. 2B and 2D, the nozzles 204 may have more than one orifice, such as branched orifices, where each of the plurality of orifices of an individual nozzle may branch from a single fluid conduit fed by the high pressure inlet 105. In various embodiments, each nozzle 204 may have three orifices, each orifice angularly spaced from an adjacent by 90 degrees, each orifice fed by a single fluid conduit. In various embodiments, each of these three orifices on the single nozzle 204 may be configured to eject fluid in three separate streams, one perpendicular to the conical surface, and the adjacent two orifices parallel to the conical surface in opposite directions. In various embodiments, the nozzles 204 may be rotated in the conical surface of the drill head 200 to aim the streams ejected therefrom. In various embodiments, the nozzle orientation or angle may be adjusted via piezoelectric elements configured to alter the spray path of the nozzle by changing size in response to one or more electrical signals.

Referring now to FIG. 2D, a schematic cross section view of drill head 200 is shown. Drill head 200 includes a venturi jet pump 128, which will be described in greater detail in reference to FIG. 3. Venturi jet pump 128 may include a piston of any length, including from about one inch nominal to one foot nominal. Venturi jet pump 128 may utilize a spiral or helical spring, or other types of springs, including wave springs, such as in a stacked configuration. The venturi jet pump 128 may have a total linear displacement of fractions of an inch along the longitudinal axis of the drill head.

Figure 3:
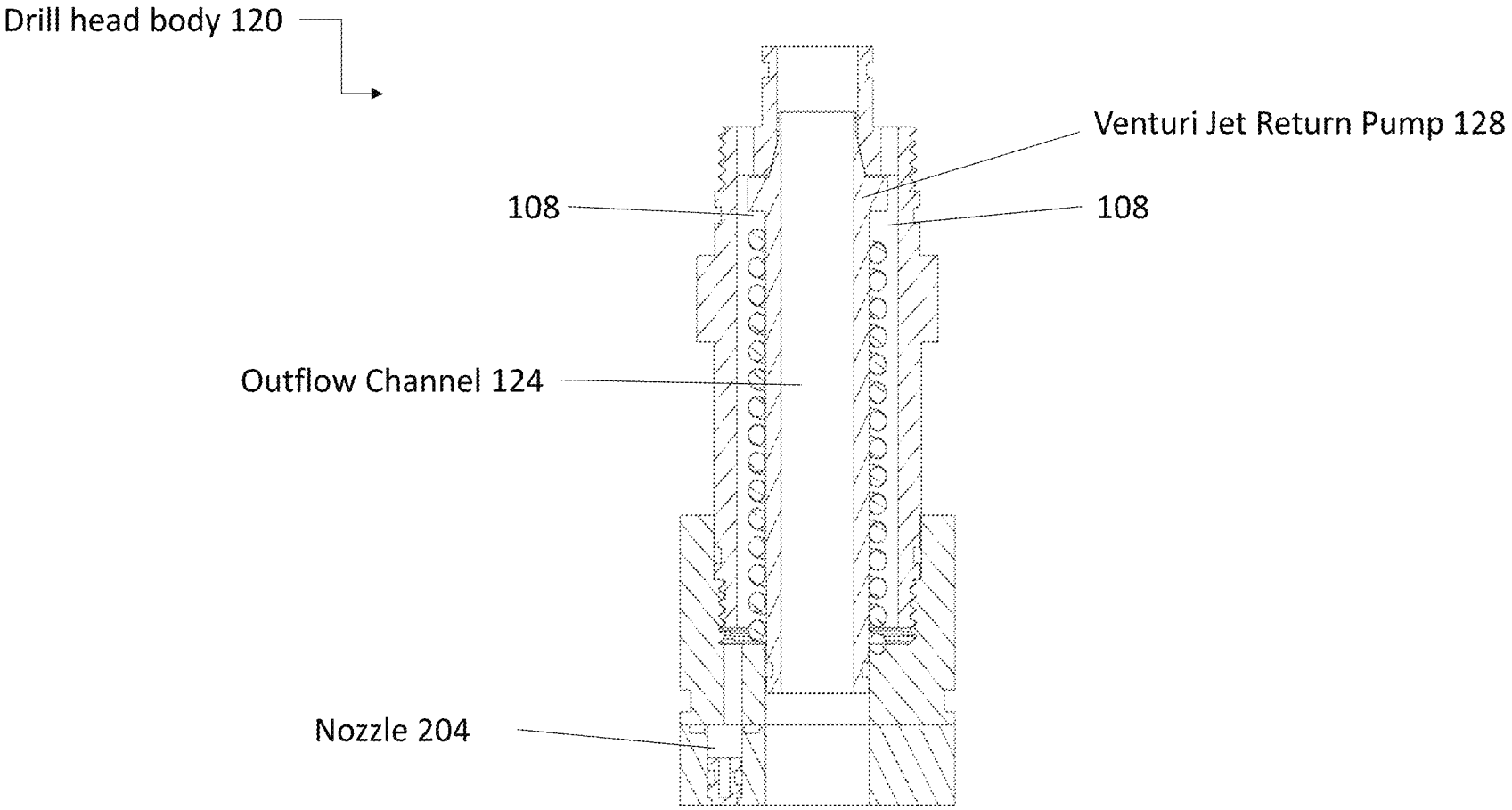
FIG. 3 is a schematic representation of a drill head body is shown in section view.

Referring now to FIG. 3, a schematic representation of a drill head body 120 is shown in section view. Drill head body 120 may be any drill head body as described herein. Drill head body 120 may be rotatably and releasably coupled to a drill casing, such as drill casing terminator 116. Drill head body 120 includes a venturi jet return pump 128. Venturi jet return pump 128 may be configured to translate axially within the drill head body 120. Venturi jet return pump 128 may be integral to the drill head body 120, for example a piston forming a portion thereof may translate within a cavity of the drill head body 120. Drill head body 120 may include constrictions, bottle necks, shoulders, or the like configured to abut and arrest a portion of the piston, thereby limiting the translation motion of the piston within the drill head body 120. As will be described in greater detail below, the piston may include a tapered or otherwise conical end configured to be inserted into a corresponding conical surface of the outflow channel 124 and sealing the outflow channel 124 from the high pressure flow channel 108. The piston may translate downward, forming an annular flow channel between the conical surfaces, fluidly connecting the high pressure flow channel 108 to the outflow channel 124. In various embodiments, the flow channel between the conical surfaces may be sloped at any angle. In various embodiments, the piston may provide a planar flow channel formed by normal surfaces opposing one another. A portion of the piston, which will be described below, may be an annular boss configured to direct a portion of the fluid traveling downward through high pressure fluid channel 108 through said annular flow channel up into the outflow channel 124. In various embodiments, the piston may have a spring biasing the piston upward and sealing the annular flow channel unless acted upon by the fluid.

Figure 4:
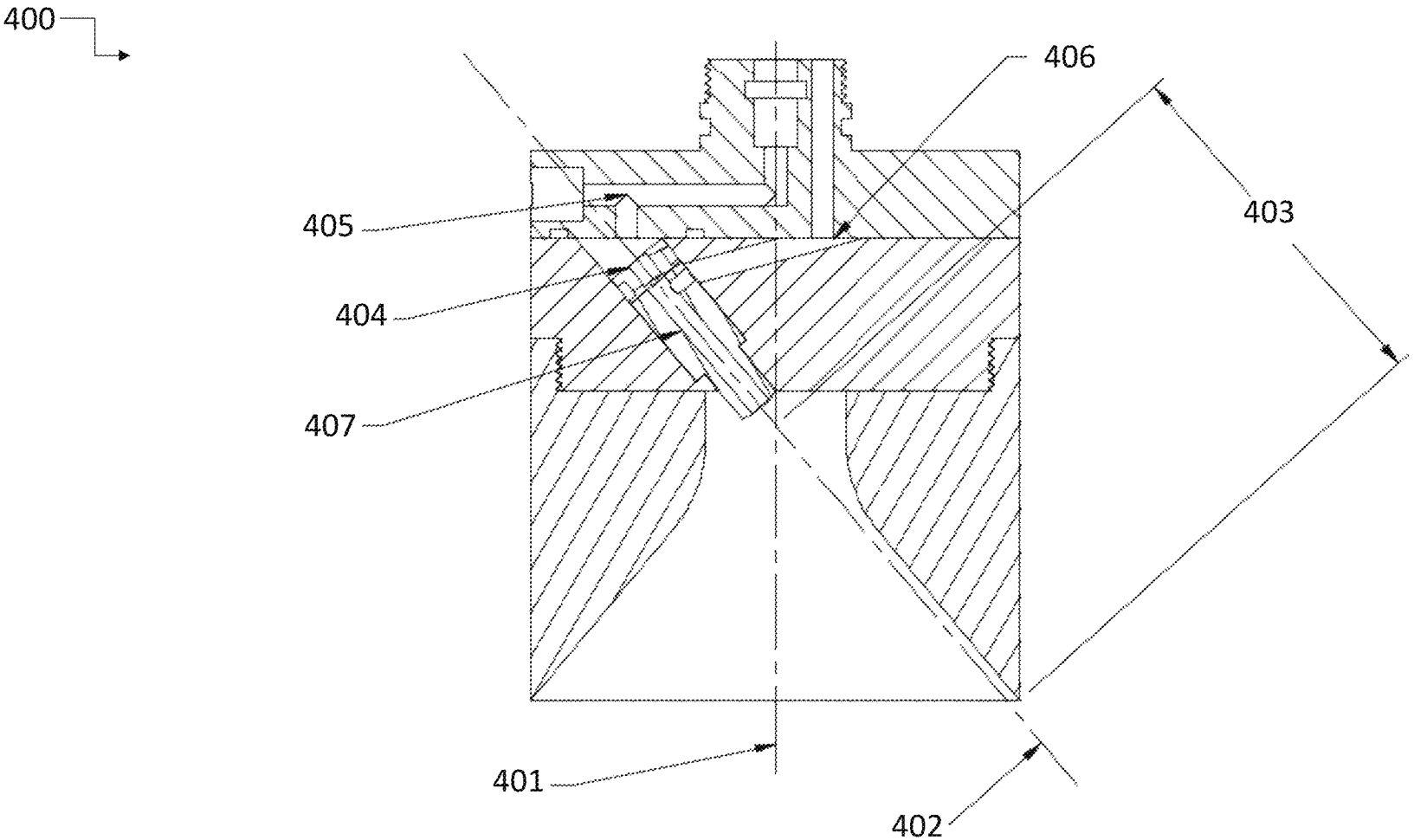
FIG. 4 illustrates a detailed cross section view of a pressurized fluid drill with only one high-velocity fluid nozzle and an optional focusing tube and associated vacuum feed line.

As shown in FIG. 4, a high velocity fluid jet drilling head is illustrated. The drilling head contains a high pressure fluid inlet 405 that provides fluid to a nozzle 404. Drill head 400 may be formed from one integral component, wherein any and all internal voids or cavities are machine or additively formed in the manufacture of drill head 400. In various embodiments, drill head 400 may include a plurality of parts and portions coupled together via one or more fastening methods such as threads, bolts, screws, or the like. Drill head 400 may include a connecting portion configured to couple the drill head to one or more preceding components, such as fluid connections, pumps, filters, actuators or the like.

In this embodiment, a drill head 400 is provided which has one or more nozzles that connect to one or more high pressure fluid passages. As pressure is generated inside of the drill head, high velocity fluid streams are forced through the nozzles and directed at the substrate. When the high velocity fluid streams meet with the substrate, the kinetic energy is converted into a high pressure region which fractures the substrate surface. In a related embodiment, the drill head could have one nozzle pointing a single fluid stream at an angle which crosses the center axis of the drilling direction. In a similar embodiment the drill head may have multiple nozzles along the surface of a cone pointing tangentially or near tangentially to the cone's surface. Each of the multiple nozzles may be supplied with individual sources of high pressure fluid or may connect to a central high pressure source passing through the central axis of the cone. In various embodiments, each nozzle may be supplied with an individual source of fluid at various pressures, for example and without limitation, one nozzle may be supplied at a first pressure, and a second nozzle may be supplied at a second pressure.

Drill head 400 may include a generally cylindrical construction, the cylindrical construction may be sized based on intended borehole to be drilled. Drill head 400 may be formed with a generally cylindrical construction aligned with the vertical axis, or any axis parallel to the borehole intended to be drilled by drill head 400. Drill head 400 may be formed with a radially symmetrical cross section. Drill head 400 may be formed with a square cross section, triangle cross section, pentagonal, hexagonal, heptagonal, octagonal or higher number of equally spaced and symmetrical sides. For example and without limitation, one or more ports may be disposed in one or more sides of the drill head 400.

Drill head 400 may be formed from one or more metals or metal alloys such as tungsten or tungsten carbide. For example and without limitation, drill head 400 may be formed from aluminum, aluminum alloys, steel alloys such as stainless steel or high carbon steel. Drill head 400 may be formed from a non-metallic material, as the drill head 400, in embodiments, need not directly contact the target material. In various embodiments, drill 400 may be formed from a high-density plastic such as high-density polyethylene (HDPE). In various embodiments, at least a portion of the drill head 400 may be formed from a first material, and a second portion of drill head 400 may be formed from a second material. For example and without limitation, the fluid lines or cavities in which fluid flows through drill head 400 may be formed from a metal such as copper or aluminum such as to stand up to the high pressure fluid. The remainder of drill head 400 may be formed from a high-density plastic configured to save weight and maneuverability.

The nozzle 404 converts the high pressure fluid into a high velocity stream along a straight trajectory 402. In various embodiments, nozzle 404 may convert the high pressure fluid into a high velocity stream along multiple straight trajectories. In various embodiments, nozzle 404 may convert the high pressure fluid into a high velocity stream for each of a plurality of orifices disposed in nozzle 404. For example and without limitation, nozzle 404 may have two orifices configured to convert the high pressure fluid into a high velocity stream along two parallel trajectories, each parallel also to 402. In various embodiments, drill head 400 may include more than one nozzle 404, each similar to the nozzle in FIG. 4, but spaced radially about the drill head 404. In various embodiments, there may be a plurality of nozzles disposed about the drill head, each oriented at an individual angle. In various embodiments, there may be a plurality of nozzles disposed about the drill head, each oriented at the same angle but pointing in an individual direction. In various embodiments, there may be a plurality of nozzles disposed about the drill head oriented at the same angle and pointed in the same direction. For example and without limitation, a second nozzle 404 may be symmetrically and oppositely spaced from the nozzle shown in FIG. 4, such as to provide a second high velocity stream in a mirrored trajectory across central axis 401 than high velocity stream 402. There may be as many channels, fluid lines, or components configured to feed the nozzles 404 as required. For example and without limitation, there may be as many high pressure fluid inlets 405 and optional channel 406 as nozzles 404. For example there may be four nozzles 404 and inlets 405, 406 equally and radially spaced about central axis 401, each nozzle spraying towards central axis 401. In various embodiments, a single nozzle configured to spray across or coaxial with the central axis, with every other nozzle of the plurality of nozzles oriented in different directions. While the exemplary embodiment shown in FIG. 4 depicts nozzles 404 having a fixed/rigid orientation, in some embodiments the nozzle orientation (or angle) can be adjusted, before or during operation of fluid flow, to change the vector of the fluid exiting the nozzle orifice. In various embodiments, the nozzle orientation or angle may be adjusted via piezoelectric elements configured to alter the spray path of the nozzle by changing size in response to one or more electrical signals. Further, each nozzle can be operated/oriented independently of each other. Similarly, the orifice size/shape can be adjusted to accommodate various fluid volumes, velocities and pressures.

Drill head 400 may include radiused corners, throttles, bottle necks and the like configured to provide the high pressure fluid without losses in pressure and wear on the equipment. In various embodiments, drill head 400 is configured to intake high pressure fluid through high pressure fluid inlet 405 continuously, in steps, parts, bursts and/or pulses. In various embodiments, high pressure fluid inlet 405 may be interchangeable within drill head 400, such as being disposed in a removable portion of drill head 400 of through one or more access ports. In various embodiments, wherein high pressure fluid inlet 405 is a recess or machined channel, there may be access ports in drill head 400 to allow access or maintenance to the inlet. In the exemplary embodiment shown in FIG. 4, the high pressure fluid inlet is oriented horizontally with a perpendicularly descending bore in fluid communication with the axis/conduit of the nozzle 404. In operation, high pressure fluid (e.g. water) is delivered through the horizontal bore and "turns", e.g. 90°, to enter the nozzle 404 for ejection to drill the desired substrate.

The drilling head may also contain an optional channel 406 that is positioned such that the high velocity stream produces a negative pressure in the channel 406 allowing for additional fluids, particles, or abrasives to be introduced into the stream after the nozzle. The drilling head may also contain a focusing tube 407 configured to allow fluids, particles, or abrasives introduced from channel 406 sufficient time to pick up kinetic energy from the high velocity stream 402. In various embodiments, focusing tube 407 may be larger in diameter than either the high pressure fluid inlet 405 and optional channel 406. In various embodiments, the focusing tube 407 may be larger in diameter than both of the high pressure fluid inlet 405 and optional inlet channel 406. In various embodiments, focusing tube 407 may be larger in diameter than the combined inner diameters of the high pressure fluid inlet 405 and the optional channel 406. In the exemplary embodiment shown in FIG. 4, the negative pressure channel 406 includes a first segment that is in fluid communication with the nozzle 404 and oriented at an angle (e.g. approximately 30° relative to the horizontal axis, and approximately 60° relative to the axis of the nozzle 404); and a second segment in fluid communication with the first segment, but oriented vertically.

In various embodiments, the fluid utilized to provide the high velocity stream may be water. In various embodiments, the fluid utilized to provide the high velocity stream may be a chemical compound. In various embodiments, the fluid utilized to provide the high velocity stream may be a solution including a particulate suspended in a medium, such as water. In various embodiments, the fluid utilized to provide the high velocity stream may be of a variable temperature, ranging from above freezing temperatures to near boiling temperatures. In various embodiments, each of the components that contact the fluid may be treated to resist rust and/or contamination from any chemical or particulate present in the fluid.

The high velocity stream 402 is produced with sufficient velocity that when it comes in contact with a brittle surface such as rock, the total enthalpy of the stream is enough to produce surface fracturing of the rock surface and or break portions of the rock surface off. In various embodiments, the high velocity fluid stream may have a velocity of approximately 100-300 meters per second (m/s). In various embodiments, the high velocity fluid stream 402 may have a velocity of approximately 35-100 m/s. In various embodiments, the high velocity fluid stream 402 may have a velocity corresponding to a target material, for example a high velocity may be employed by the system to impact a harder rock target, the higher velocity may be accomplished by an increase in pressure. Alternatively, if abrasive particles are introduced into the focusing tube 407, the abrasive particles may pick up sufficient velocity such that they provide a cutting or grinding force on the surface of the target material. In various embodiments, the fluid provided in the high velocity stream 402 may include particulate that provides a cutting or grinding force on the surface of the target material. In various embodiments, one or more of the pressure of the feed, velocity streams and rotation of the drill head may be adjusted based on target material. For example and without limitation, the drill head may be rotated at a greater rotational velocity with a higher feed pressure and therefore greater stream velocity for harder target materials, such as granite, than a softer target material, such as sandstone. In various embodiments, the drill head may rotate in response to the high velocity streams or high pressure feed. In various embodiments, the drill head may be rotated by an actuator disposed within the borehole or drill string, or disposed above the surface of the borehole.

In various embodiments, the target material may be regolith, such as sand, gravel, loose earth, dirt, rocks, pebbles or any other unconsolidated, loose, heterogeneous superficial deposits. In various embodiments, the target material may be various regolith present together, such as gravel suspended in sand or the like. Because the tensile strength of rock or regolith (force holding it together) is so much less than its compressive strength, the high pressure fluid stream can impart local fractures in the rock and then pressurize the fractures, thereby breaking the rock from the inside, effectively. A fluid stream with a high pressure differential accelerates to a high velocity, This high velocity impacts the rock with a very high force and creates high pressures inside and/or on the rock grain, causing it to break apart for removal or be moved out of the outflow path until it is broken down to an ingestible size.

The nozzle 404 is positioned in such a way that the high velocity stream 402 passes through the central axis 401 of the drilling head 400. The drilling unit may also contain a conical recessed section 403 that is configured such that the angle of the interior space matches the angle of the fluid stream 402. The conical section 403 may be further configured such that the extent of the conical section 403 matches the effective penetrating depth of the velocity stream. For example and without limitation, the distal end of the drill head 400, which in use is disposed at the deepest portion of the borehole, may be configured to physically touch the target material at the bottom of the borehole. That is to say that the height of the conical recess section 403 measure parallel to the central axis 401 may be configured to provide a standoff between the target material and the nozzle 404. Therefore, conical section 403 may be configurable to alter the distance the high velocity stream travels before contacting a target material. In various embodiments, any component described herein may be swapped or angled to alter the angle at which the fluid stream is dispensed toward the target material. In FIG. 4, threads can be seen coupling the conical section 403 to the nozzle 404 portion, allowing for switching or removal of conical section 403.

When configured with a conical section, the cutting action is such that as the drill head 400 is rotated, the surface of the target is cut away in a matching area to the surface of the conical section. The distance between the high velocity stream 402 and the target surface is controlled by lowering the drill head until the conical section is up against the target surface. In this way, no complex controls are required to position the high velocity stream.

In various embodiments, drill head 400 may include one or more ports, pipes, channels or the like, configured to intake debris that has been fractured by the drill. In various embodiments, the drill head 400 may include one or more centrally-located channels configured to intake broken target material (such as pulverized rock) via a pressure differential and transport said target material up and out of the borehole. In various embodiments, the return channel may be a hollow tube leading from the bottom of the borehole to the surface, disposed through the drilled head (400, 500).

Figure 5:
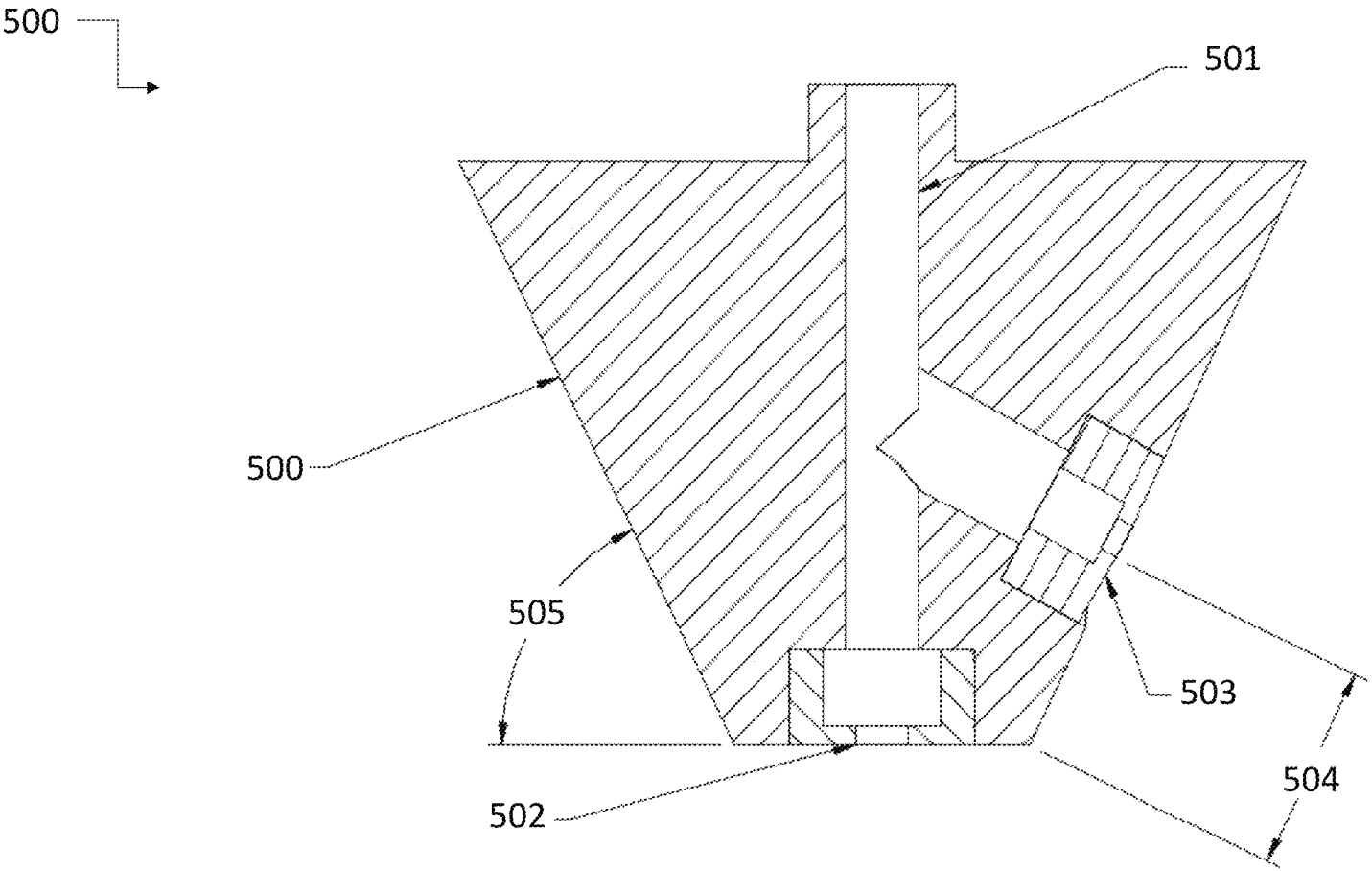
FIG. 5 illustrates a detailed cross section view of a pressurized fluid drill with multiple nozzles attached to a conical drilling surface.

Referring now to FIG. 5, a drilling head 500 that operates in a similar manner to the embodiment outlined in FIG. 4 is shown in section view. Drill head 500 may be formed from one or more metals or metal alloys such as tungsten or tungsten carbide. For example and without limitation, drill head 500 may be formed from aluminum, aluminum alloys, steel alloys such as stainless steel or high carbon steel. Drill head 500 may be formed from a non-metallic material, as the drill head 400. In various embodiments, drill 500 may be formed from a high-density plastic such as high-density polyethylene (HDPE). In various embodiments, at least a portion of the drill head 500 may be formed from a first material, and a second portion of drill head 500 may be formed from a second material Drill head 500 may be formed from one integral component, wherein any and all internal voids or cavities are machine or additively formed in the manufacture of drill head 500. In various embodiments, drill head 500 may include a plurality of parts and portions coupled together via one or more fastening methods such as threads, bolts, screws, or the like. Drill head 500 may include a connecting portion configured to couple the drill head to one or more preceding components, such as fluid connections, pumps, filters, actuators or the like, the connecting portion disposed proximate the wide side of the conical surface. The connecting portion may be a threaded boss configured to screw into a similarly threaded receiver of another component. The connecting portion, as well as any other portion of drill head 500 may be water tight or sealed against the ingress of a liquid such as water. In various embodiments, the connecting portion may be typical between any components described herein, for example and without limitation, the connecting portion between the drill head 500 and the drill string may be the same or similar to consecutive portions of the drill string.

Drill head 500 may include a generally radially symmetrical construction, the radially symmetrical construction may be sized based on intended borehole to be drilled. Drill head 500 may be formed with a radially symmetrical construction aligned with the vertical axis. Drill head 500 may be formed with a radially symmetrical cross section, such as circular. Drill head 500 may be formed with a square cross section, triangle cross section, or pentagonal, hexagonal, heptagonal, octagonal or higher number of equally spaced and symmetrical sides. For example and without limitation, one or more ports may be disposed in one or more sides of the drill head 500. In various embodiments, the drill head 500 may include a radially asymmetrical construction.

Drill head 500 shows an inverted conical drill head that tapers vertically at a certain angle 505, the apex (or smallest cross-sectional area) of drill head 500 at a first end, and the large cross-section area at a second end proximate a coupling features. In various embodiments, drill head 500 may have a conical surface angle 505 configured for a target material, such as a first angle for regolith and a second angle for bedrock/solid rock. In various embodiments, conical surface angle 505 may be any angle, including horizontal, such that drill head 500 includes a planar terminal end, for example and without limitation. In various embodiments, drill head 500 may be replaceable or switchable based on target material to be drilled. In various embodiments, drill head 500 may be adjustable. For example and without limitation, drill head 500 may include a conical surface with interleaving components that may be actuated or rotated to vary the overall angle of the conical surface of drill head 500. For example and without limitation, drill head 500 may be actively adjusted during drill operation. In various embodiments, drill head 500 may be manually adjusted or physically adjusted by one or more operators between drilling operations or before a drilling operation commences. In various embodiments, drill head 500 may have a smooth, continuous conical surface. In various embodiments, drill head 500 may have a textured, toothed, or otherwise conical surface with at least one raised feature protruding therefrom. For example and without limitation, drill head 500 may include at least one ridge, boss, tooth, protrusion, knob, blade or other abrasive or ablative feature disposed on the conical surface of drill head 500. In various embodiments, the nozzles themselves may be configured to contact and guide target material into one or more outflow channels or into the path of a high pressure fluid stream. Although drill head 500 may operate largely without physically contacting the target material, any one or more abrasive or ablative feature may assist, direct, or break up any target material contacting said conical surface. For example, one or more water jet may force one or more broken pieces of rock or earth up towards the sides of the drill head 500, in said case, the broken piece of rock or earth may be further broken or directed back downward towards the tip of the drill 500, proximate the apex of the cone.

The drilling head 500 includes a central fluid inlet channel 501 such that fluid can easily be transferred to one or more nozzles located on the central axis (extending vertically, radially centered within central fluid inlet channel 501), or to a nozzle on the conical surface 503. In the exemplary embodiment shown, a second nozzle 503 is provided with the same internal diameter as the first nozzle 502 conduit, with the second nozzle oriented at an obtuse (e.g. 430°) relative to the first nozzle 502 conduit. In various embodiments, any nozzle may include a different internal diameter than first nozzle conduit. In various embodiments, the nozzle may include a lesser or greater internal diameter than first nozzle conduit. The central fluid inlet channel 501 may be a high pressure fluid inlet that provides fluid to one or more nozzles 502, 503. For example and without limitation, the fluid lines or cavities in which fluid flows through drill head 500 may be formed from a metal such as copper or aluminum such as to stand up to the high pressure fluid. In various embodiments, any internal channel may include a flexible line configured to transmit fluid through the system. In various embodiments, one or more fluid lines may be disposed within the cavities or channels. In various embodiments, one or more filters may be disposed within the central fluid inlet channel 501.

With further reference to FIG. 5, drill head 500 may have a plurality of fluid nozzles 502, 503 that may be pointed vertically in the direction of drilling, horizontally away from the rotational axis, or at an angle in between, such as any angle between 502 and 503 (or at an angle opposite the tip of drill head 500.

The nozzles 502, 503 create a controlled high velocity stream along the trajectory orthogonal to the nozzle placement in drill head 500. As shown in FIG. 5, in various embodiments, nozzles 502, 503 may convert the high pressure fluid into a high velocity stream along multiple straight trajectories, such as at an angle from conical surface (203) and vertically through nozzle (202). In various embodiments, nozzle 502, 503 may convert the high pressure fluid into a high velocity stream for each of a plurality of orifices disposed in each nozzle 502, 503.

For example and without limitation, nozzles 502, 503 may have two orifices configured to convert the high pressure fluid into a high velocity stream along two parallel trajectories, each parallel also to 402. In various embodiments, drill head 400 may include more than one nozzles 502, 503, each similar to the nozzle in FIG. 4, but spaced radially about the drill head 404. For example and without limitation, a second nozzles 502, 503 may be symmetrically and oppositely spaced from the nozzle shown in FIG. 4, such as to provide a second high velocity stream in a mirrored trajectory across central axis 401 than high velocity stream 402. There may be as many channels, fluid lines, or components configured to feed the nozzles 502, 503 as required. For example and without limitation, each nozzle 502, 503 may be centrally connected to central fluid inlet 501. For example there may be two, three, four or more radially spaced nozzles along conical surface, similar to nozzle 503. For example the nozzles may be equally and radially spaced about central axis, each nozzle spraying outward and downward from an orifice similar to nozzle 503.

In various embodiments, nozzles 502, 503 on the conical drill head 500 are positioned such that the distance between the nozzles 504 is configured to match the diameter of surface removed by each fluid stream produced by each nozzle. The conical angle 505 is further configured such that the penetrating depth of material removal from each fluid stream is a set proportion of the distance between the nozzles. In this manner the conical angle 505 may be adjusted to allow for a shallower angle with more nozzles or a steeper angle with fewer nozzles to match corresponding adjustments in fluid pressure and flow rate.

Figure 6A:
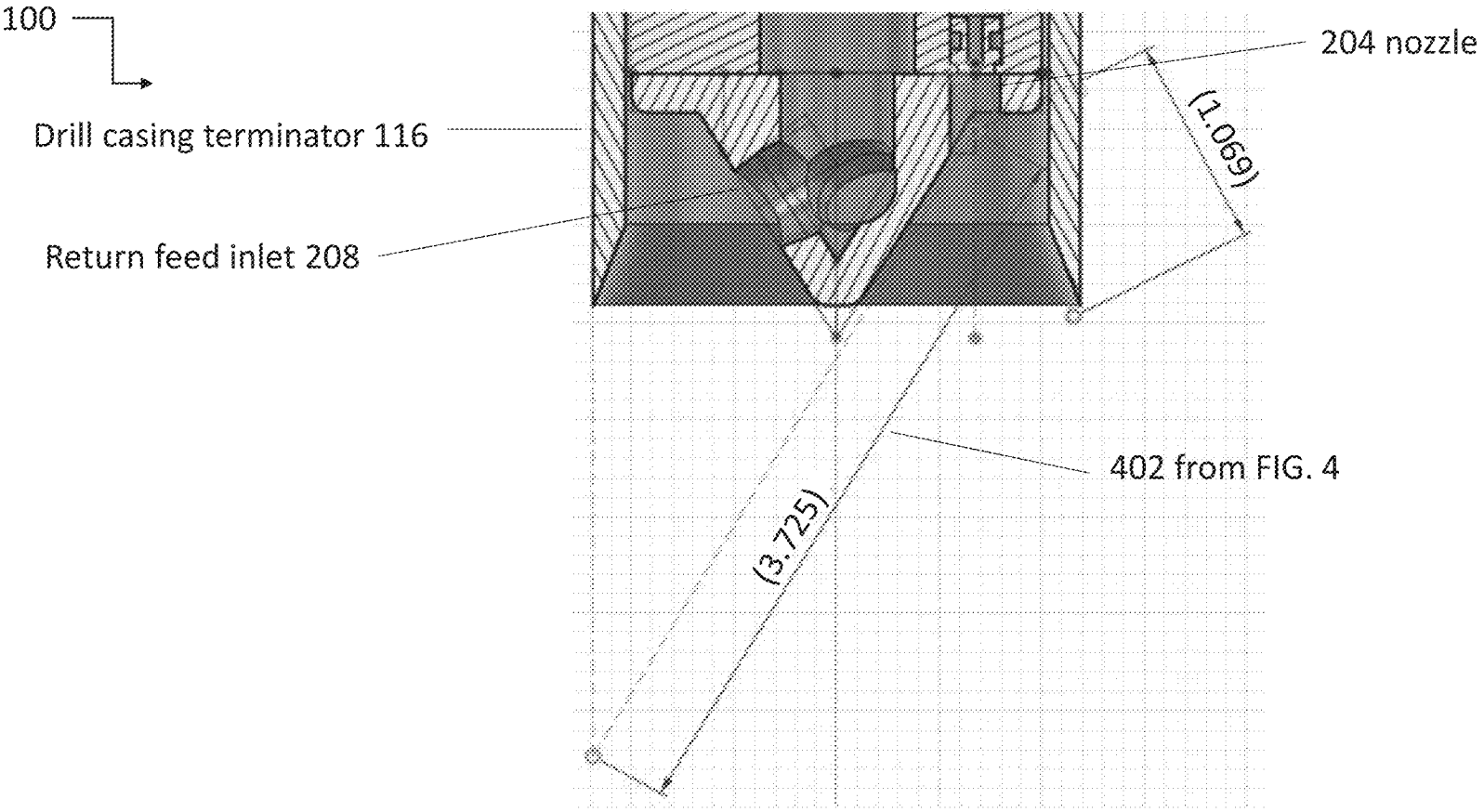
FIG. 6A-B are schematic views of a drill head is shown in cross-sectional view.
Figure 6B:
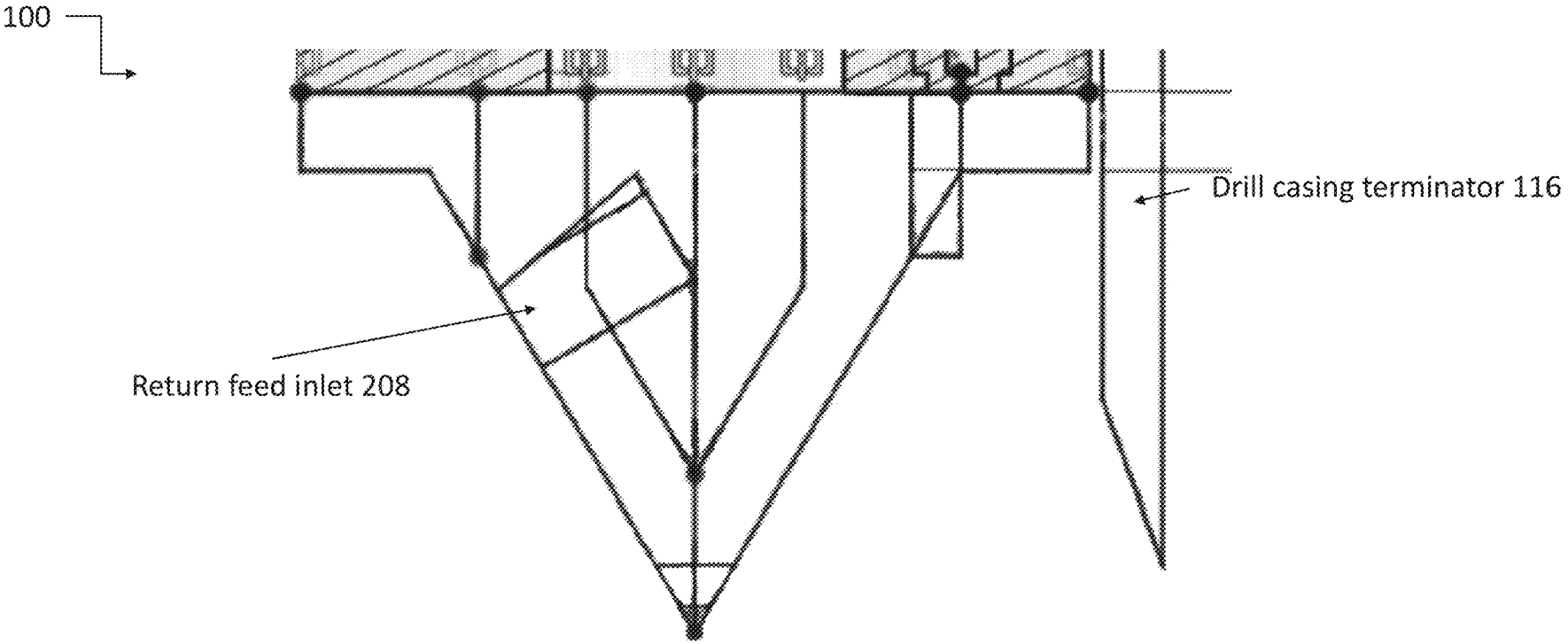

Referring now to FIG. 6, a schematic view of a drill head 100 is shown in cross-sectional view. The nozzle 204 converts the high pressure fluid into a high velocity stream along a straight trajectory 402. In various embodiments, nozzle 204 may convert the high pressure fluid into a high velocity stream along multiple straight trajectories. In various embodiments, nozzle 204 may convert the high pressure fluid into a high velocity stream for each of a plurality of orifices disposed in nozzle 204. For example and without limitation, nozzle 204 may have two orifices configured to convert the high pressure fluid into a high velocity stream along two parallel trajectories, each parallel also to 402. In various embodiments, drill head 100 may include more than one nozzle 204, each similar to the nozzle in FIG. 4, but spaced radially about the drill head 204. For example and without limitation, a second nozzle 204 may be symmetrically and oppositely spaced from the nozzle shown in FIG. 4, such as to provide a second high velocity stream in a mirrored trajectory across the rotational axis than high velocity stream 402. There may be as many channels, fluid lines, or components configured to feed the nozzles 204 as required. For example and without limitation, there may be as many high pressure fluid inlets 405 as nozzles 204. For example there may be four nozzles 204 and inlets 405 equally and radially spaced about central axis, each nozzle spraying towards central axis. While the exemplary embodiment shown in FIG. 4 depicts nozzles 204 having a fixed/rigid orientation, in some embodiments the nozzle orientation (or angle) can be adjusted, before or during operation of fluid flow, to change the vector of the fluid exiting the nozzle orifice. Further, each nozzle can be operated/oriented independently of each other. Similarly, the orifice size/shape can be adjusted to accommodate various fluid volumes, velocities and pressures.

With continued reference to FIG. 6, drill head 100 may include more than one nozzle 204 as described above. In various embodiments, nozzle 204 may be adjustable such that the exit trajectory of the fluid may be amiable or movable. In various embodiments, nozzle 204 may be configured for spraying the fluid in an inward direction towards the centerline of the drill head 100, such as parallel to a conical face radially symmetrical about the centerline, as shown in FIG. 6. In various embodiments, nozzle 204 may be configured to rotate about the longitudinal axis of the drill head, wherein the nozzle sprays in a diagonal trajectory that traces a cone as the drill head 100 rotates. In various embodiments, nozzle 204 may spray inwardly and configured to contact the target material at a location underneath the opposite arcuate wall of the drill head 100, thereby cutting material to form a borehole with about the same diameter of drill head 100.

With continued reference to FIG. 6, drill head 100 may include one or more nozzles configured to spray the cutting fluid in an outward direction, wherein the outward direction is generally opposite the central axis of the drill head 100. For example and without limitation, the outward spraying fluid may contact the target material at a location proximate the outer diameter of the casing and/or drill string. In various embodiments, the angle at which the outward flow exits the one or more nozzles may be 30 degrees, 45 degrees, or 60 degrees, among any other angle. In various embodiments, one or more nozzles may be configured to spray the inward trajectory fluid and the outward trajectory fluid simultaneously. In various embodiments, one nozzle may be configured to spray inward and another nozzle may be configured to spray outward. Any number of nozzles may be configured to spray any combination of inward and outward trajectories. The outward spraying nozzles may shorten the distance the inward nozzle has to clear by removing the target material proximate the outer wall across the central axis from the nozzle.

With continued reference to FIG. 6, drill head 100 may include one or more nozzles configured to spray directly downward relative to the nozzle and drill head 100. For example and without limitation, the nozzles may be configured to eject the cutting fluid at an angle normal to the bottom of the borehole, or parallel with the central axis of the drill head 100. For example and without limitation, the nozzles may be configured to spray fluid approximately normally to the bottom of the borehole. In various embodiments, the nozzles may be configured to spray the fluid approximately normally to the bottom of the borehole, for example crossed with a fluid stream from an adjacent nozzle. Any of the nozzles described herein may be used in combination. For example and without limitation, a single nozzle may be configured to simultaneously spray both inwardly and outwardly. For example and without limitation, a single nozzle may be configured to simultaneously spray inwardly, downwardly and outwardly. For example and without limitation, a single nozzle may be configured to switchably pivot between inward, downward and outward spray directions, or a combination thereof. For example and without limitation, the one or more nozzles may include more than one orifice, at least one of which corresponding to each spray direction, the switchable configuration may selectively open and close said orifices to switch the spray direction.

Figure 7:
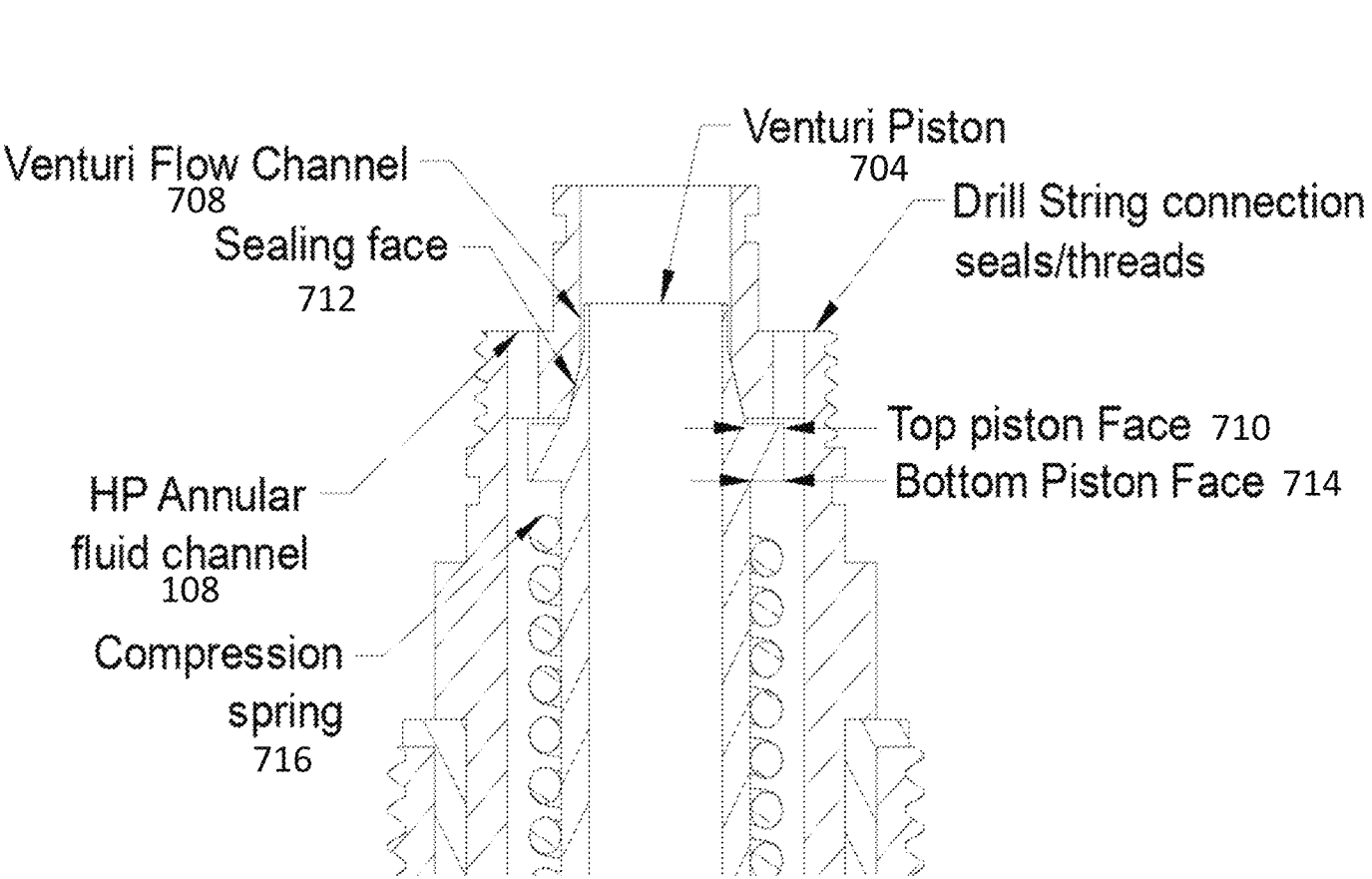
FIG. 7 is a schematic diagram of a venturi jet return pump is shown in cross sectional view.

Referring now to FIG. 7, a schematic diagram of a venturi jet return pump 128 is shown in cross sectional view. Venturi jet return pump may be disposed within drill head body 120. Venturi jet return pump 128 may include concentrically disposed section of cylindrical pipe, the sections of pipe configured to translate relative to one another, at least one of the pipes configured to slide within a second pipe. The Venturi jet 128 may be connected to the outflow channel 124 and/or form a part thereof. The venturi jet 128 may be disposed at the end of the outflow channel 124 proximate and within the drill head 120. The venturi jet 128 may extend from the outflow channel 124 within the drill string to the distal end of the drill head proximate the nozzles.

Venturi jet 128 includes a venturi piston 704. Venturi piston 704 may be at least partially seated inside the distal end of an outflow channel 124 extending up and throughout the drill string. Venturi piston 704 may be formed from aluminum or another metal. Venturi piston 704 may be formed from one or more metal alloys such as steels. Venturi piston 704 may be formed from one or more plastics as described herein. Venturi piston 704 may be generally cylindrical, having an inner surface and an outer surface, the outer surface disposed within a central channel with the drill head body 120. Venturi piston 704 may be configured to translate up and down within the drill head body 120. In various embodiments, venturi piston 704 may be configured to form a venturi flow channel 708. Venturi flow channel 708 may be an annular spaced formed by a portion of venturi piston 704 and a relatively stationary drill head body 120. Venturi piston 704 may be forced downward by a high pressure fluid, such as water, flowing downward through the high pressure flow channels 108 pressing down on a top piston face 710. Venturi piston 704 may include one or more annular portions having a boss, face or other surface on which the fluid may exert a force. The sealing face 712 may also form a linear stop against a portion of the drill head body 120, the sealing face 712 abutting a surface of the venturi flow channel 708, thereby arresting the upward motion of the venturi piston 704. In various embodiments, the top piston face 710 may also form a linear stop against a portion of the drill head body 120, the top piston face 710 abutting a surface of the drill head body 120, thereby arresting the upward motion of the venturi piston 704.

Venturi flow channel 708 may be formed between venturi piston 704, and more specifically a sealing face 712. Sealing face 712 may be a concentrically and conically formed surface configured to seat within a concave conical portion of the drill head body 120. The sealing face 712 may terminate at the top piston face 710 at its bottom-most portion. Sealing face 712 may include one or more corresponding features configured to align said venturi piston 704 and drill head body 120. Venturi flow channel 708 may be a ring-shaped space that expands as venturi piston 704 translates downward in response to the high pressure fluid flowing down through the high pressure flow channels 108—thereby opening the venturi flow channel 708 between the sealing face potion 712. In various embodiments, venturi piston 704 may be configured to translate downward in response to a mechanical interaction therewith, for example by a push rod or the like, configured to open or maintain the venturi flow channel 708 in an open position without the pressure from the incoming fluid.

Venturi het 128 includes a compression spring 716. The compression spring 716 may be disposed spirally about the outer surface of venturi piston 704. Compression spring 716 may extend around the venturi piston 704 from the bottom piston face 714 at a top end and a surface of the drill head body 120 at a bottom-most end. The compression spring 716 may be configured to bias the venturi piston 704 closed against the conical sealing face 712 against the drill head body 120. Compression spring 716 may compress the venturi piston 704 against the drill head body 120 by exerting an upward force on the bottom piston face 714. In various embodiments, high pressure fluid flow from drill string pressurizes the area inside the drill head body 120. The compression spring 716 pushes upwards on the venturi piston 704, sealing the high pressure fluid from the outflow channel 124. In various embodiments, the difference of area between the top piston face 710 and the bottom piston face 714 creates a downward force on the piston 704. In various embodiments, the high pressure flow within the high pressure flow channel 108 may exert about 80 pounds of force at about 4000 PSI. In various embodiments, any portion of venturi piston 704 may be sized up or down to account for an operating pressure of the fluid. For example, the piston faces may be sized up to exert a larger force by a lower pressure fluid system.

Figure 8:
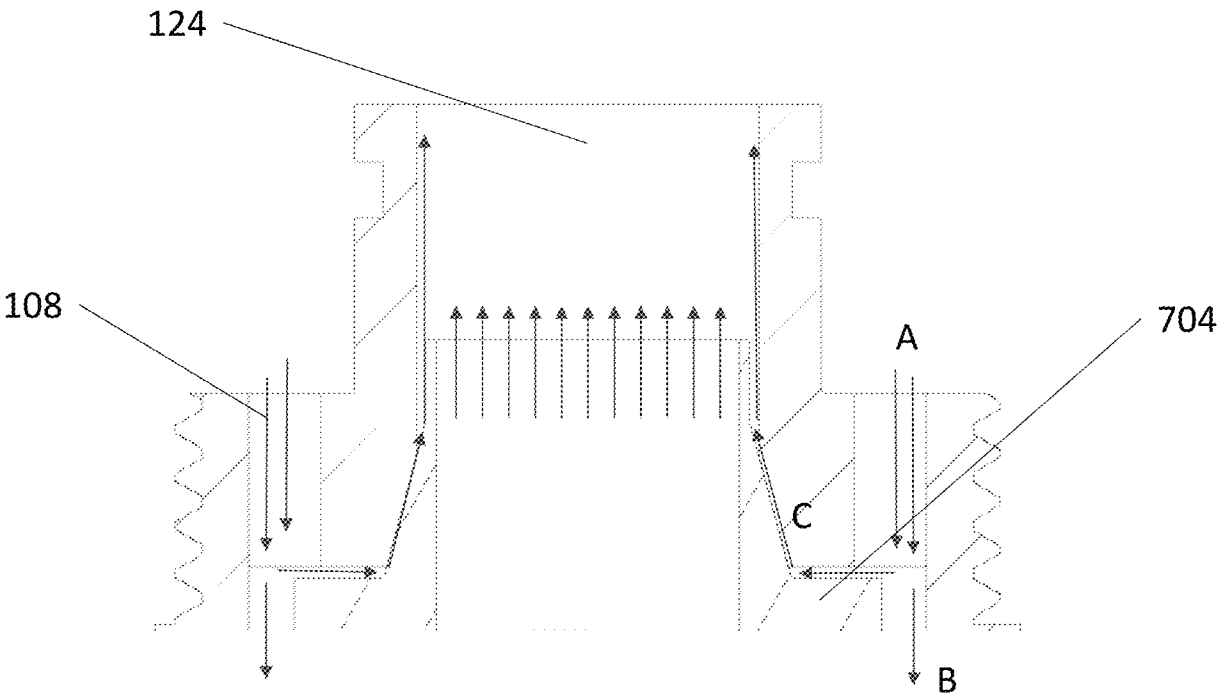
FIG. 8 is a schematic diagram of the venturi piston and drill head body in cross sectional view.

Referring now to FIG. 8, a schematic diagram of the venturi piston and drill head body in cross sectional view. High pressure flow is shown by the inclusion of the arrows "A". The arrows do not imply relative pressure, mass flow, volumetric flow or any other relative measurement based on the number of arrows. High pressure fluid flows downward through high pressure flow channel 108, which may be an annular channel or a plurality of distinct and radially emplaced channels within the drill head 100. The high pressure fluid may be water and flow from the drill string downward through the drill head 100. High pressure fluid may exert a force on venturi piston 704 as described herein above. Venturi piston 704 may translate downward in response to the high pressure fluid flow with an opposite force exerted thereon by the compression spring as described above. The venturi piston 704 may form the venturi flow channel with the drill head body 120 as it translates downward.

In accordance with an aspect of the present disclosure, and with continued reference to FIG. 8, while a portion (e.g. majority) of the fluid flow "A" continues downward as shown by arrow "B" to perform the cutting operation, a portion of the high pressure fluid flow "C" may then deviate from its downward trajectory within high pressure flow channel 108 and turn inwardly and upwardly though the venturi flow channel. The high pressure flow may then travel upward along outflow channel 124 through the centermost portion of the drill head 100 up through the center of the drill string to the surface outside the borehole. The velocity from the fluid flowing up through the venturi channel into the outflow channel 124 causes a negative pressure at the return feed inlet 208 as shown in FIG. 6. For example and without limitation, in a sealed borehole, the fluid outside the drill head may be at a greater pressure than the outflow channel thus causing flow up the outflow channel. In another example and without limitation, in a loose target material, where fluid can move through the target material, the venturi jet may be opened to pull fluid and cuttings up through the outflow channel, thus removing the cuttings from the drilling surface. In various embodiments, the venturi jet pump may be controlled via changing pressure and flow of the high pressure fluid.

With continued reference to FIG. 8, the venturi pump 128 may be self-regulating. As the high pressure fluid flow is increased upstream of the venturi pump 128, the venturi piston 704 extends further downward and thus the venturi channel 708 opens more, thus increasing the flow through the venturi jet which in turn, decreases the pressure in the drill head creating a positive feedback loop to control pressure below a set point. There may be a limit to the amount the venturi piston 704 may translate against the compression spring 716 by one or more annular opposite and abutting faces, the contact from which arrests the motion of the venturi piston 704. When pressure increases, the downward force on the piston overcomes the spring force, the sealing face opens up creating a relatively small annular opening, the venturi flow channel 708. The high pressure fluid accelerates in the venturi flow channel to a high upwards velocity, the flow reducing the pressure in the drill head body 120 creating a positive feedback loop to control the pressure=. The wider the venturi flow channel 708 in turn increases the flow and thus lowers the pressure. The venturi jet pump 128 provides pumping force to pump fluid and cuttings to the surface of the borehole by providing suction force to draw cuttings back into the drill head 120 from the bottom of the borehole and positive pressure to move cuttings and fluid to the top of the borehole. Additionally, the venturi jet pump 128 regulates pressure in the drill body, for example, when a nozzle (204) clogs, the flow out of the nozzle is reduced, which in turn creates a higher pressure inside of the drill head, the venturi jet pump regulates this pressure by opening to allow more flow. In various embodiments, the venturi piston 704 may further (due to the increased negative pressure driving the debris return path through outflow channel 124) to allow extra flow into the return flow. As described above, the venturi jet pump 128 can start/stop pumping flow into the outflow channel 124 depending on feed pressure and flow within the high pressure flow channel 108. In the case of a permeable substrate (the regolith above), the venturi jet pump 128 may increase the pumping action in lost fluid situations, allowing for more fluid to be delivered to the nozzles in the case when fluid is lost to the outflow channel 124. Conversely, in situations with a denser substrate of target material, the venturi jet pump 128 may be configured to reduce the pumping action, as the fluid in the outflow channel 124 may be sufficient to move crushed material up through said outflow channel 124 at a lower pressure.

Figure 9:
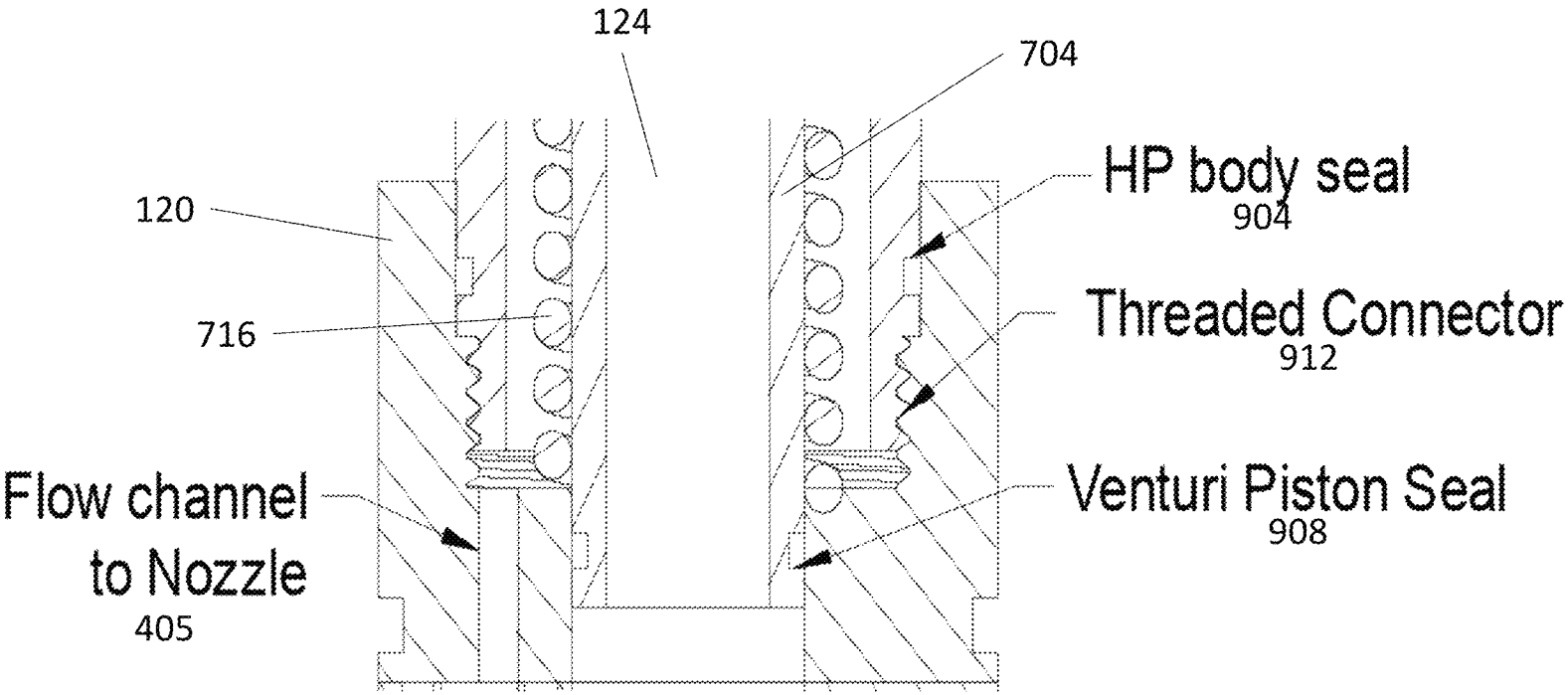
FIG. 9 is a schematic diagram of a bottom portion of the drill head body is shown in cross-sectional view.

Referring now to FIG. 9, a schematic diagram of a bottom portion of the drill head body 120 is shown in cross-sectional view. As can be seen in this detailed view of the bottom-most portion of the drill head body 120, the bottom portion of venturi piston 704 can be seen with the compression spring 716 spirally disposed there about. The compression spring 716 may be seated on the drill head body 120, having an annular floor on which the spring can rest surrounding the venturi piston 704. The venturi piston 704 may be seated within at least one cylindrical space within the drill head body 120 and configured to move there within. The venturi piston 704 may include a venturi piston seal 908, the venturi piston 908 may include a gasket or O-ring forming a seal between the piston and the drill head body 120. Although not seen in the schematic diagram, there may be a channel laterally emplaced within the venturi piston 704 wherein the gasket can be seated. Additionally, there may be a high pressure body seal 904 similarly formed between the portions of the drill head body 120. Similar to the venturi piston seal 908, the high pressure body seal 904 may be a gasket or O-ring seated within a laterally annular groove. The portions of the drill head body 120 may be connected via corresponding inner and outer threads on threaded connector 912.

Figure 10:
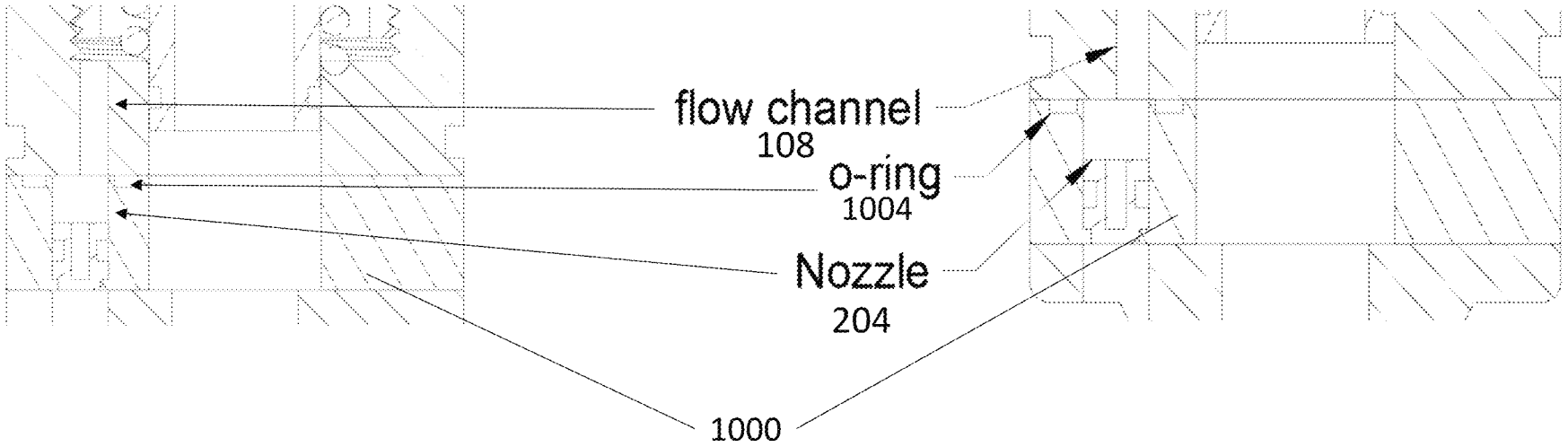
FIG. 10 is a schematic diagram of a drill nozzle body shown in cross-sectional view.

Referring now to FIG. 10, a schematic diagram of a drill nozzle body is shown in cross-sectional view. Drill nozzle body 1000 may be a cylindrically formed component having one or more nozzles, such as those described above in reference to nozzle 204 formed therein. Drill nozzle body 1000 may be generally cylindrical and attached to the drill head body 120. Drill nozzle body 1000 may be bolted onto the drill head body 120. Drill nozzle body 1000 may be threaded onto the drill head body 120, with annular or radially disposed components aligned for fluid flow therethrough. For example and without limitation, nozzle 204 may be radially emplaced on drill nozzle body 1000 at a location directly underneath and in fluid communication with high pressure flow channel 108. There may be one or more corresponding features configured to align said components that are radially symmetrical. For example and without limitation, any cylindrical component may be formed with flats configured to accept wrench grips or the like.

In various embodiments, drill nozzle body 1000 may be integrally formed with drill head body 120. For example and without limitation, nozzles 204 may be integrally formed within the high pressure flow channels 108. Nozzles 204 may be a hole or orifice formed in a solid drill nozzle body 1000 and in fluid communication with high pressure flow channel 108. In various embodiments, nozzles 204 may be configurable based on the radial position of drill nozzle body 1000. For example, nozzle 204 may have a fixed in fluid communication with high pressure flow channel 108. As the drill nozzle body 1000 is rotated relative to the drill head body 120, the relative angle of the nozzle may be altered. In various embodiments, nozzle 204 may include an asymmetrical contour such that it cannot rotate. In various embodiments, one or more nozzles may have an orifice formed at an angle to create a jet that comes out at an angle not parallel to the hole. For example and without limitation, one or more nozzles may be disposed on the outer diameter of the drill head with the jet pointing toward the rotational axis. The one or more nozzles may have an orifice disposed at an angle thereto to accomplish this. In various embodiments, the nozzle may be generally circular relative to the cavity in which it sits within the drill head, but have an asymmetrical portion configured to form a jet at an angle to the cavity.

Figure 11:
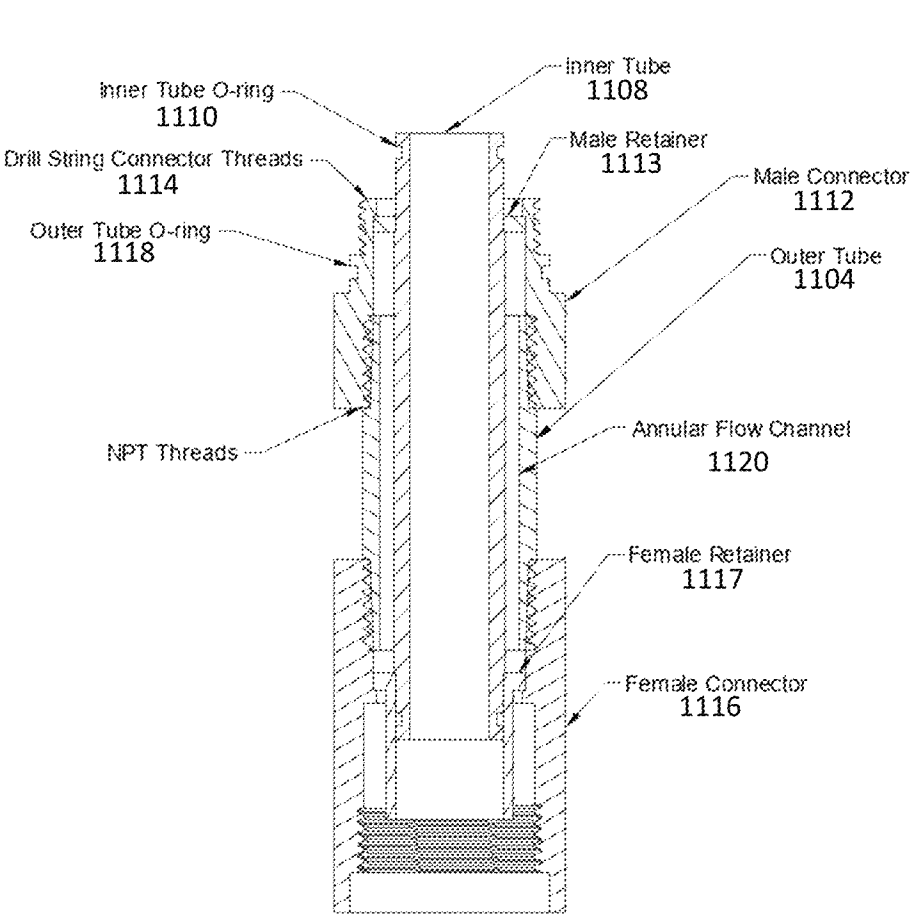
FIG. 11 is a schematic diagram of a drill string connector in cross sectional view.

Referring now to FIG. 11, a schematic diagram of a drill string connector 1100 in cross sectional view. Drill string connector 1100 may be primarily ISO standard "black" pipe and/or ANSI schedule steel pipe. The length of drill string can be any length based on whatever pipe length is cut then add the connectors to the end. Drill string connector 1100 may be configured to connect any two components within the drill string, including another drill string connector. For example and without limitation, there may be a plurality of drill string connectors 1100 in series in order to extend the drill string down a borehole. This disclosure does not seek to limit the number of drill string connectors 1100 that may be connected in series or between a certain number of components. Drill string connector 1100 includes outer tube 1104 concentrically and surrounding an inner tube 1108. The inner tube may be ½" inch nominal diameter. The outer tube may be a 1" inch nominal diameter. The inner tube and outer tube may form an annular flow channel therebetween. The annular flow channel 1120 may be the same or similar to high pressure flow channel 108 as described herein. In various embodiments, annular flow channel 1120 may be in fluid communication with high pressure flow channel 108. Annular flow channel 1120 may be emplaced at the same diameter within the drill string connector 1100 as the high pressure flow channels 108 are emplaced on drill head 100. In various embodiments, drill string connector 1100 includes a male connector 1112 threaded onto the outer tube 1104, the male connector 1112 emplaced around a portion of inner tube 1108. The male connector 1112 may include internal threads configured to mate with threads on the outer tube 1104 and external drill string connector threads 1114 configured to be threaded onto one or more corresponding threads to another female connector as will be described below. Male connector 1112 may have a male retaining feature 1113. Male retaining feature 1113 rings may be configured to hold the inner pipe in place and keep it from sliding up and/or down within the outer tube. The male retaining feature 1113 may have one or more grooves or holes formed therein to allow for high pressure fluid flow to pass therethrough and into the other wide of the drill string connector 1100. The male retaining feature 1113 ma include a filter membrane emplaced therein configured to filter out any debris traveling up the outflow channel 124 that the inner surface of the inner tube 1108 forms. In various embodiments, the male retaining feature 1113 may include a filter membrane configured to filter out any debris traveling downward through the annular flow channel 1120.

Drill string connector 1100 includes a female connector 1116. Female connector 1116 may be emplaced at an end of the outer tube 1104 and inner tube 1108. Female connector 1116 may include a first end and a second end defining a cylindrical length therebetween. The female connector 1116 may include internal threads on both of the first and second ends. The internal threads of the first end may be configured to thread onto corresponding threads of the outer tube 1104 and receive inner tube 1108 there within. In various embodiments, inner tube 1108 may be longer than outer tube 1104, the inner tube 1108 extending past the end of the outer tube 1104. Female connector also includes internal threads within the second end. The second ends internal threads are configured to thread onto the external threads of a male connector from an adjacent drill string connector 1100. Female connector 1116 may include a female retaining feature 1117. Female retaining feature 1117 rings may be configured to hold the inner pipe in place and keep it from sliding up and/or down within the outer tube. The female retaining feature 1117 may have one or more grooves or holes formed therein to allow for high pressure fluid flow to pass therethrough and into the other wide of the drill string connector 1100. Female retaining feature 1117 ring is extended to form the female bore seal to connect the two lengths of Inner Pipe.

Drill string connector 1100 may include one or more outer tube O-rings 1118. There may be one or more channels or grooves within the outer tube 1104 configured to retain or partially seat the O-ring within. In various embodiments, the channels or grooves may include crush ring seals. The O-ring or crush seals may be configured to form a fluid seal between the male and the female connectors of a connected drill string connector 1100. Drill string connector 1100 may include one or more inner tube O-rings 1110. There may be one or more channels or grooves within the inner tube 1108 configured to retain or partially seat the O-ring within. The O-ring may be configured to form a fluid seal between the inner tube 1108 and the female connector of a connected drill string connector 1100. In various embodiments, one or more casings may be coupled to the outer surface of the drill string connector 1100. The casing may be a generally cylindrical wall having an inner surface coupled to the drill string connector 1100 and an outer surface configured to abut or form a near seal to the borehole within which the drill string is disposed. The casing may be rotatably coupled to the drill string connector 1100 such that the drill string connector 1100 may rotate within the casing.

Figure 12:
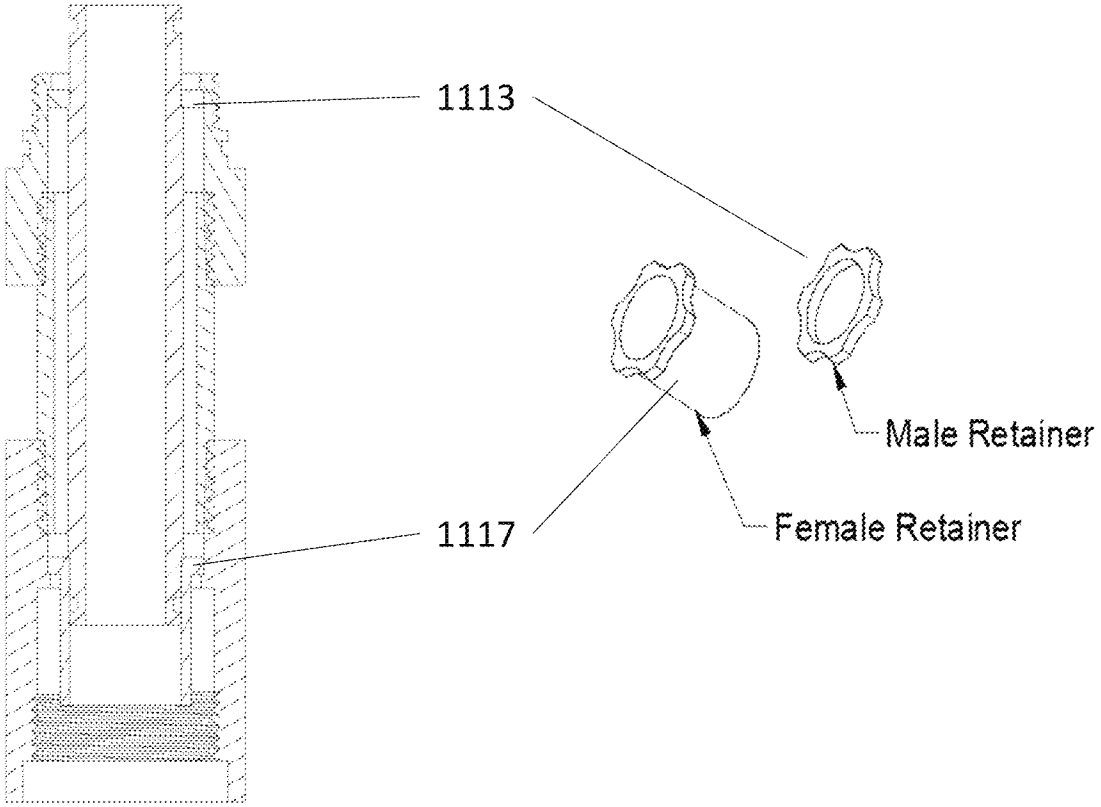
FIG. 12 is a schematic diagram of drill string connector and retainers are shown in cross sectional and isometric views, respectively.

Referring now to FIG. 12, a schematic diagram of drill string connector 1100 and retainers are shown in cross sectional and isometric views, respectively. Drill string connector 1100 may be primarily ISO standard "black" pipe. The length of drill string can be any length based on whatever pipe length is cut then add the connectors to the end. Drill string connector 1100 may be configured to connect any two components within the drill string, including another drill string connector. For example and without limitation, there may be a plurality of drill string connectors 1100 in series in order to extend the drill string down a borehole. This disclosure does not seek to limit the number of drill string connectors 1100 that may be connected in series or between a certain number of components. In various embodiments, drill string connector 1100 may be between approximately one and ten feet in length. In various embodiments, drill string connector 1100 may be approximately four feet in length. Drill string connector 1100 includes outer tube 1104 concentrically and surrounding an inner tube 1108. The inner tube may be ½" inch nominal diameter. The outer tube may be a 1" inch nominal diameter. The inner tube and outer tube may form an annular flow channel therebetween. The annular flow channel 1120 may be the same or similar to high pressure flow channel 108 as described herein. In various embodiments, annular flow channel 1120 may be in fluid communication with high pressure flow channel 108. Annular flow channel 1120 may be emplaced at the same diameter within the drill string connector 1100 as the high pressure flow channels 108 are emplaced on drill head 100. In various embodiments, drill string connector 1100 includes a male connector 1112 threaded onto the outer tube 1104, the male connector 1112 emplaced around a portion of inner tube 1108. The male connector 1112 may include internal threads configured to mate with threads on the outer tube 1104 and external drill string connector threads 1114 configured to be threaded onto one or more corresponding threads to another female connector as will be described below. Male connector 1112 may have a male retaining feature 1113. Male retaining feature 1113 rings may be configured to hold the inner pipe in place and keep it from sliding up and/or down within the outer tube. The male retaining feature 1113 may have one or more grooves or holes formed therein to allow for high pressure fluid flow to pass therethrough and into the other wide of the drill string connector 1100. In various embodiments, the male retaining feature 1113 may include a filter membrane configured to filter out any debris traveling downward through the annular flow channel 1120. Male retaining feature 1113 may be an annulus or ring having scalloped outer perimeter, the scallops configured to allow flow therethrough. The inner surface of the ring may be configured to seat within a groove within the inner tube 1108.

Drill string connector 1100 includes a female connector 1116. Female connector 1116 may be emplaced at an end of the outer tube 1104 and inner tube 1108. Female connector 1116 may include a first end and a second end defining a cylindrical length therebetween. The female connector 1116 may include internal threads on both of the first and second ends. The internal threads of the first end may be configured to thread onto corresponding threads of the outer tube 1104 and receive inner tube 1108 there within. In various embodiments, inner tube 1108 may be longer than outer tube 1104, the inner tube 1108 extending past the end of the outer tube 1104. Female connector also includes internal threads within the second end. The second ends internal threads are configured to thread onto the external threads of a male connector from an adjacent drill string connector 1100. Female connector 1116 may include a female retaining feature 1117. The female retaining feature 1117 may be a cylinder having a scalloped flange disposed at one end. The scalloped flange may allow for flow therethrough. The cylindrical wall extending therefrom may be retained by abutting a portion of the female connector 1116. Female retaining feature 1117 rings may be configured to hold the inner pipe in place and keep it from sliding up and/or down within the outer tube. The female retaining feature 1117 may have one or more grooves or holes formed therein to allow for high pressure fluid flow to pass therethrough and into the other wide of the drill string connector 1100. Female retaining feature 1117 ring is extended to form the female bore seal to connect the two lengths of Inner Pipe.

Figure 13:
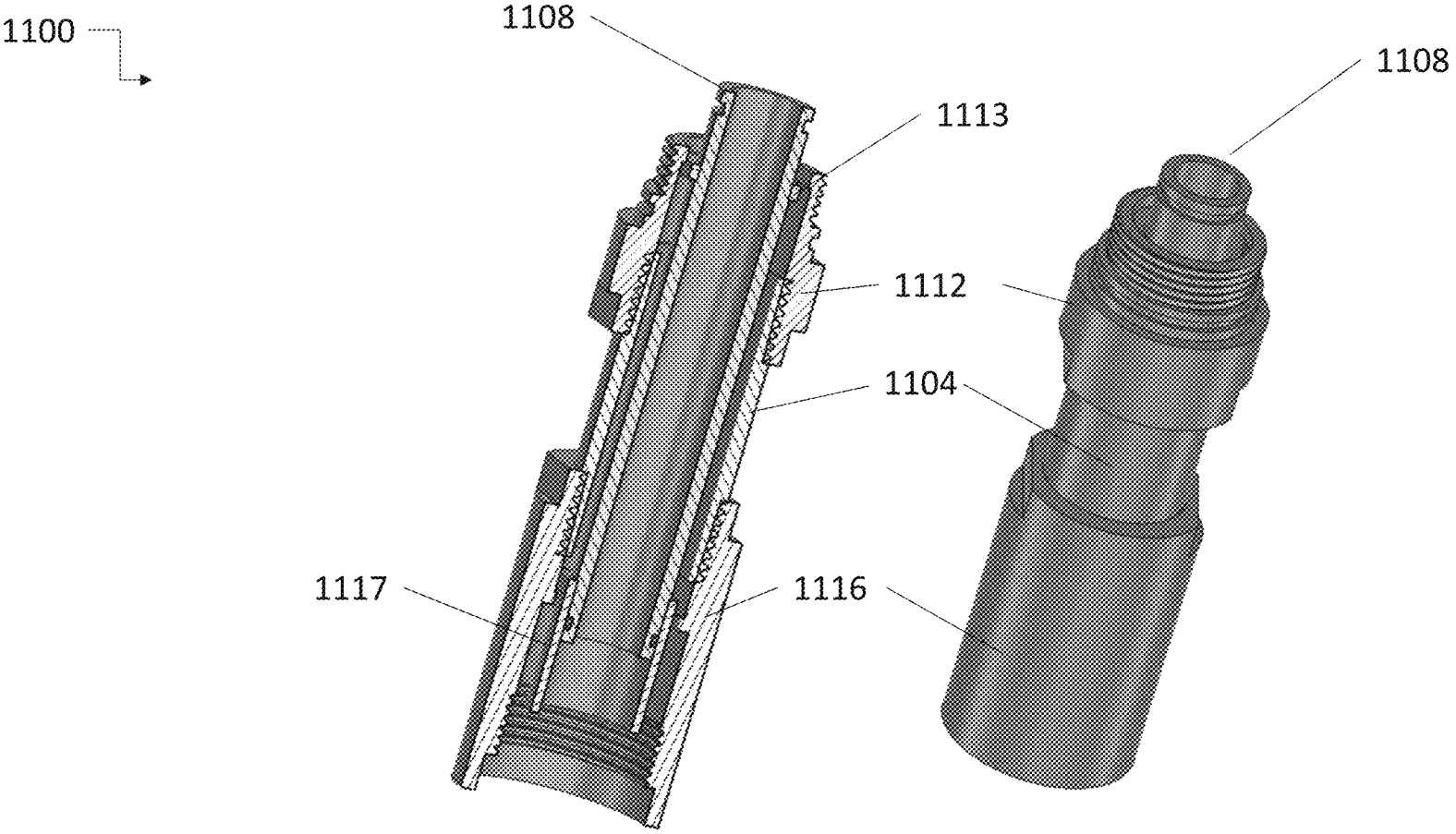
FIG. 13 is a schematic diagram of drill string connector is shown in cross sectional isometric view and assembled isometric view.

Referring now to FIG. 13, schematic representations of drill string connector 1100 is shown in cross sectional isometric view and assembled isometric view. The length of drill string can be any length based on whatever pipe length is cut then add the connectors to the end. Drill string connector 1100 may be configured to connect any two components within the drill string, including another drill string connector. For example and without limitation, there may be a plurality of drill string connectors 1100 in series in order to extend the drill string down a borehole. This disclosure does not seek to limit the number of drill string connectors 1100 that may be connected in series or between a certain number of components. Drill string connector 1100 includes outer tube 1104 concentrically and surrounding an inner tube 1108. The inner tube and outer tube may form an annular flow channel therebetween. In various embodiments, annular flow channel 1120 may be in fluid communication with high pressure flow channel 108. In various embodiments, drill string connector 1100 includes a male connector 1112 threaded onto the outer tube 1104, the male connector 1112 emplaced around a portion of inner tube 1108. The male connector 1112 may include internal threads configured to mate with threads on the outer tube 1104 and external drill string connector threads 1114 configured to be threaded onto one or more corresponding threads to another female connector as will be described below. Male connector 1112 may have a male retaining feature 1113 as described above.

Drill string connector 1100 includes a female connector 1116. Female connector 1116 may be emplaced at an end of the outer tube 1104 and inner tube 1108. Female connector 1116 may include a first end and a second end defining a cylindrical length therebetween. The female connector 1116 may include internal threads on both of the first and second ends. The internal threads of the first end may be configured to thread onto corresponding threads of the outer tube 1104 and receive inner tube 1108 there within. In various embodiments, inner tube 1108 may be longer than outer tube 1104, the inner tube 1108 extending past the end of the outer tube 1104. Female connector 1116 also includes internal threads within the second end. The second ends internal threads are configured to thread onto the external threads of a male connector from an adjacent drill string connector 1100.

Female connector 1116 may include a female retaining feature 1117 as described above.

Drill string connector 1100 may include one or more outer tube O-rings 1118. There may be one or more channels or grooves within the outer tube 1104 configured to retain or partially seat the O-ring within. The O-ring may be configured to form a fluid seal between the outer tube 1104 and the female connector of a connected drill string connector 1100. Drill string connector 1100 may include one or more inner tube O-rings 1110. There may be one or more channels or grooves within the inner tube 1108 configured to retain or partially seat the O-ring within. The O-ring may be configured to form a fluid seal between the inner tube 1108 and the female connector of a connected drill string connector 1100. In various embodiments, one or more casings may be coupled to the outer surface of the drill string connector 1100. The casing may be a generally cylindrical wall having an inner surface coupled to the drill string connector 1100 and an outer surface configured to abut or form a near seal to the borehole within which the drill string is disposed. The casing may be rotatably coupled to the drill string connector 1100 such that the drill string connector 1100 may rotate within the casing.

Figure 14:
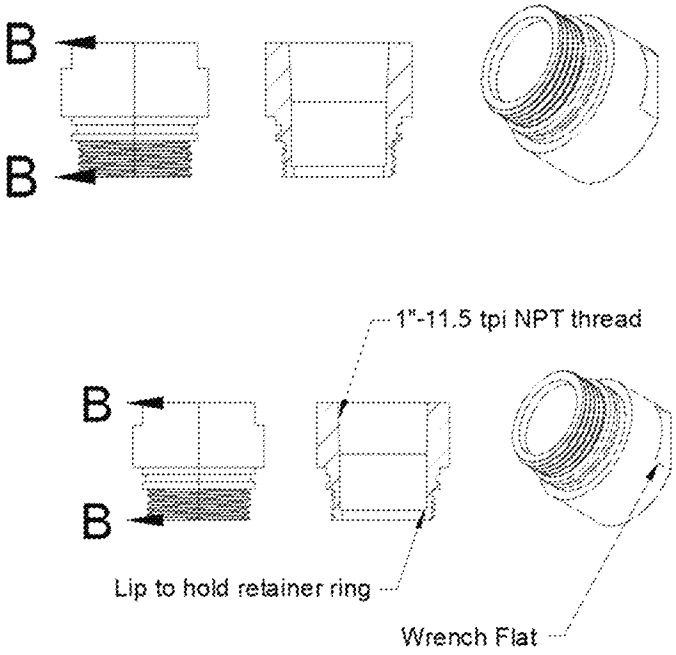
FIG. 14 is a schematic diagram of a male connector is shown in cross sectional and isometric views.

Referring now to FIG. 14, a schematic diagram of a male connector is shown in cross sectional and isometric views. Male connector 1112 may be disposed at the upper section of drill string connector 1100. Male connector 1112 may be used at the upper end of the drill string so that during drilling/use when the surface unit detaches from the drill string, another drill string connector 1100 or component can be connected thereto. Male connector 1112 may be configured to seal against any excess water/rock cuttings against ingress into the drill string connector 1100. Male connector 1112 may allow for easy inspection of O-rings and threads, as the male connector 1112 has external and upwardly disposed threads. The surface unit sealing surfaces may be female bores so there is no O-ring on the surface unit which has the most repeated use. Male connector 1112 may have any number of wrench flats. Male connector 1112 may have 1" 11.5 TPI NPT threads. Male connector 1112 may have an internally disposed lip configured to hold the male retaining feature 1113 therebetween.

Figure 15:
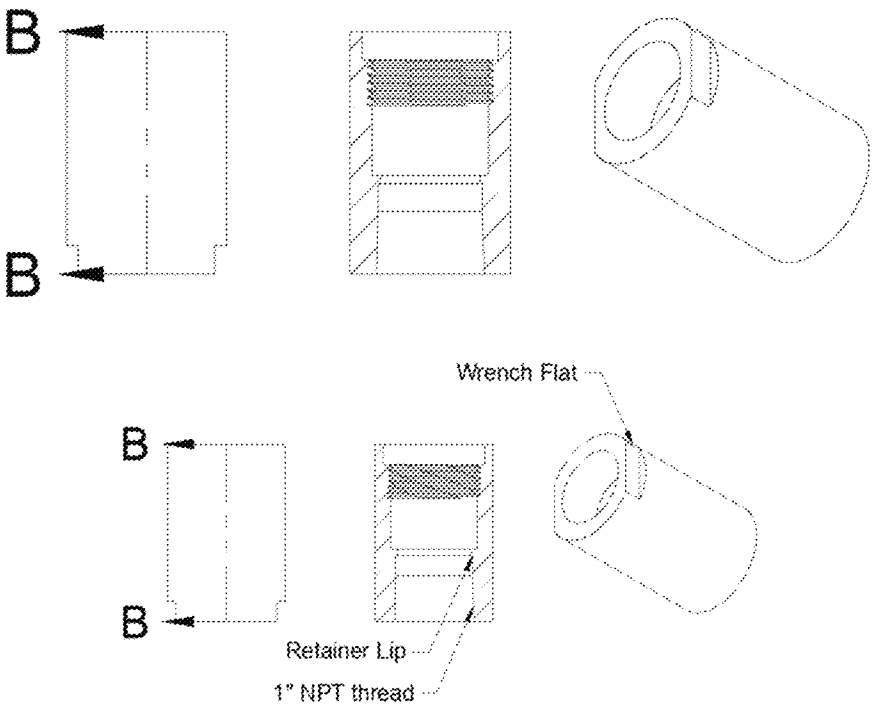
FIG. 15 is a schematic diagram of a female connector is shown in cross sectional and isometric views.

Referring now to FIG. 15, a schematic diagram of a female connector is shown in cross sectional and isometric views. Female connector 1116 may have any number of wrench flats. Female connector 1116 may have 1" 11.5 TPI NPT threads. Female connector 1116 may have an internally disposed lip configured to hold the male retaining feature 1113 therebetween. Female connector 1116 may be emplaced at an end of the outer tube 1104 and inner tube 1108. Female connector 1116 may include a first end and a second end defining a cylindrical length therebetween. The female connector 1116 may include internal threads on both of the first and second ends. The internal threads of the first end may be configured to thread onto corresponding threads of the outer tube 1104 and receive inner tube 1108 there within. In various embodiments, inner tube 1108 may be longer than outer tube 1104, the inner tube 1108 extending past the end of the outer tube 1104. Female connector also includes internal threads within the second end. The second ends internal threads are configured to thread onto the external threads of a male connector from an adjacent drill string connector 1100. Female connector 1116 may include a female retaining feature 1117.

Figure 16:
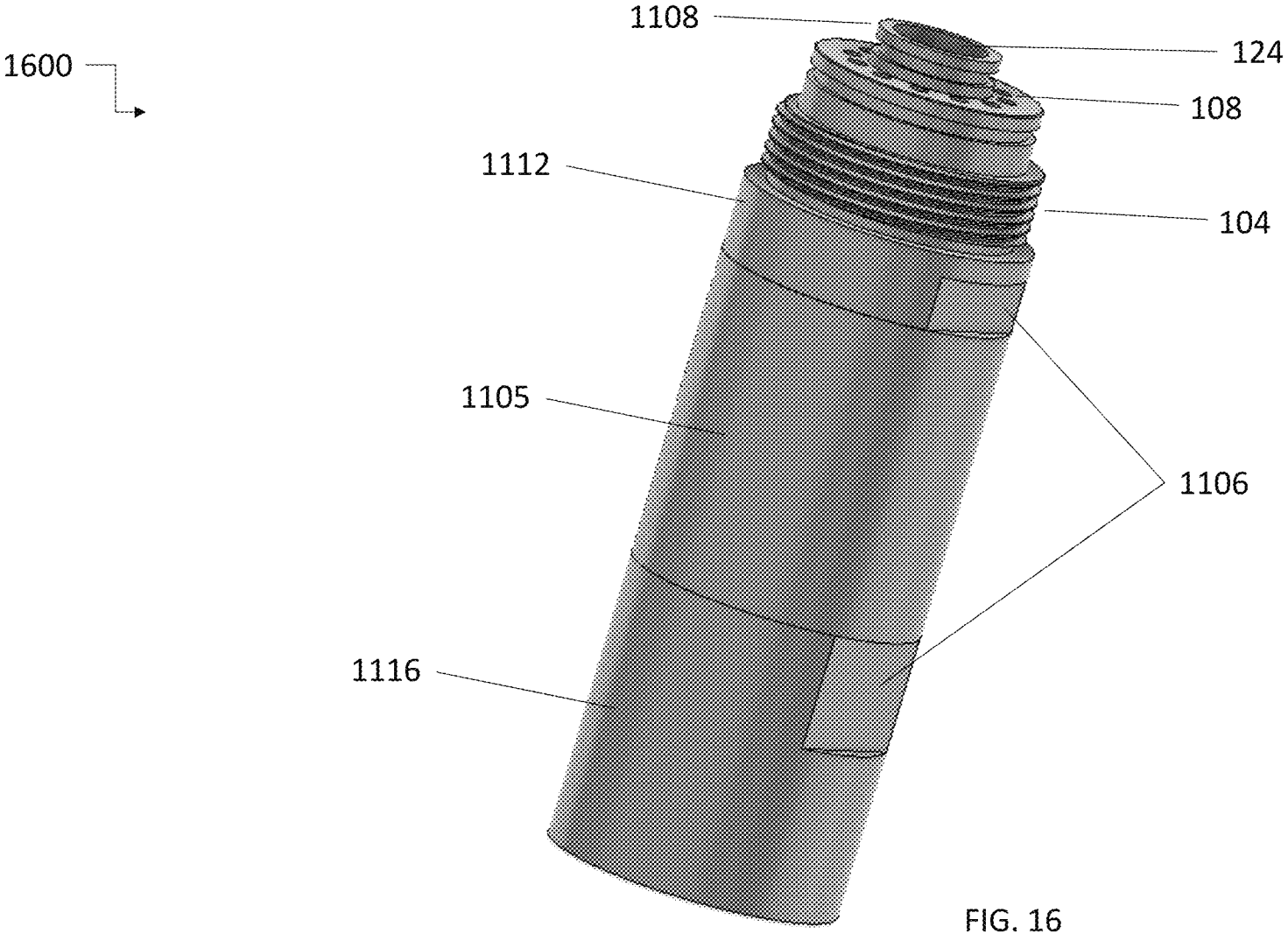
FIGS. 16-17 are schematic diagrams of drill string connectors shown in perspective and cross sectional views, respectively.
Figure 17:
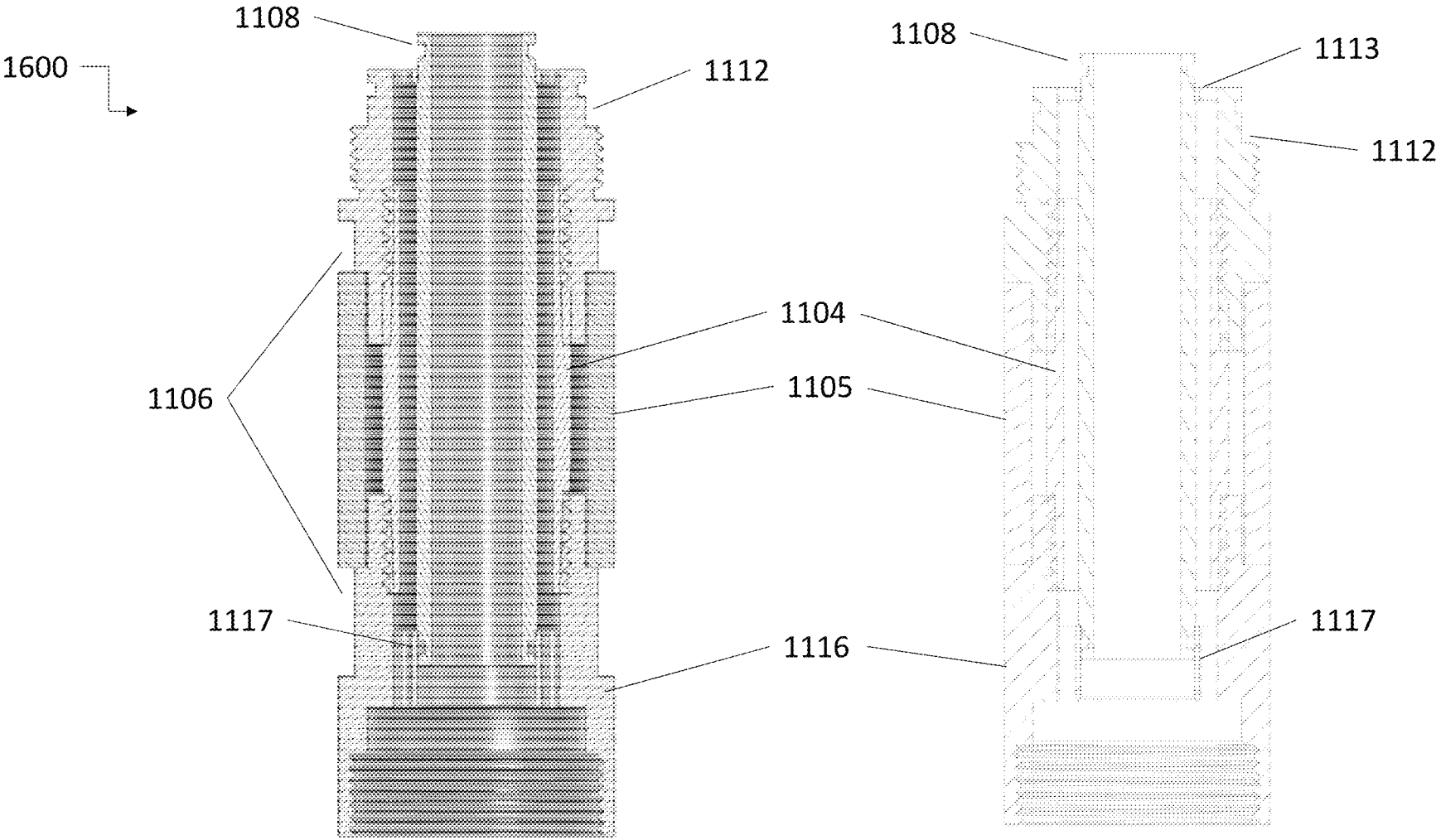

Referring now to FIGS. 16-17, schematic representations of drill string connector 1600 is shown in perspective and sectional views, respectively. Drill string connector 1600 may be similar to drill string connector 1100. The length of drill string connector 1600 can be any length based on whatever pipe length is cut then add the connectors to the end. Drill string connector 1600 may be configured to connect any two components within the drill string, including another drill string connector (e.g., drill string connector 1100, 1600). For example and without limitation, there may be a plurality of drill string connectors 1600 in series in order to extend the drill string down a borehole or shaft. This disclosure does not seek to limit the number of drill string connectors 1600 that may be connected in series or between a certain number of components. Drill string connector 1600 may include outer tube 1104 concentrically spaced from and circumferentially encompassing an inner tube 1108. The inner tube and outer tube may form an annular flow channel therebetween and may be in fluid communication with high pressure channel 108. In various embodiments, with the annular flow channel in fluid communication with one or more discrete or individual high pressure flow channels 108 concentrically disposed about the longitudinal axis of the drill string connector or upstream components.

In various embodiments, drill string connector 1600 includes a male connector 1112 threaded onto the outer tube 1104, the male connector 1112 disposed at one end of the drill string connector 1600. The male connector 1112 may include internal threads configured to mate with threads on the outer tube 1104 and external drill string connector threads 1114 configured to be threaded onto one or more corresponding threads to another female connector as will be described below. Male connector 1112 may have a male retaining feature 1113. In various embodiments, male connector 1112 may include a cut out or wrench flat 1106 in order to accept a wrench for tightening the male connector 1112 with any threaded component.

Drill string connector 1600 includes a female connector 1116. Female connector 1116 may be emplaced at the opposite end of the outer tube 1104 and inner tube 1108 from male connector 1112. Female connector 1116 may include a first end and a second end defining a cylindrical length therebetween. The female connector 1116 may include internal threads on both of its first and second ends. The internal threads of the first end may be configured to thread onto corresponding threads of the outer tube 1104 and receive inner tube 1108 there within. In various embodiments, inner tube 1108 may be longer than outer tube 1104, the inner tube 1108 extending past the end of the outer tube 1104. Female connector 1116 also includes internal threads within the second end. The second ends internal threads are configured to thread onto the external threads of a male connector from an adjacent drill string connector 1100. Female connector 1116 may include a female retaining feature 1117 as described above. In various embodiments, female connector 1116 may include a cut out or wrench flat 1106 in order to accept a wrench for tightening the male connector 1112 with any threaded component. In various embodiments, the length and rotation of the internal threads of the female connector 1116 and or the male connector 1112 may be configured such that the flow channels of the female retaining feature 1117 and the male retaining feature 1113 are aligned when connected.

Drill string connector 1600 may include one or more outer tube O-rings similar to O-rings 1118 described above. There may be one or more channels or grooves within the outer tube 1104 configured to retain or partially seat the O-ring within. The O-ring may be configured to form a fluid seal between the outer tube 1104 and the female connector of a connected drill string connector 1100. Drill string connector 1100 may include one or more inner tube O-rings similar to O-rings 1110 described above. There may be one or more channels or grooves within the inner tube 1108 configured to retain or partially seat the O-ring within. The O-ring may be configured to form a fluid seal between the inner tube 1108 and the female connector of a connected drill string connector 1600.

In various embodiments, one or more casings 1105 may be coupled to the outer surface of the drill string connector 1600. The casing 1105 may be a generally cylindrical wall having an inner surface coupled to the drill string connector 1600 and an outer surface configured to abut or form a near seal to the borehole within which the drill string is disposed. The casing 1105 may be rotatably coupled to the drill string connector 1600 such that the drill string connector 1600 may rotate within the casing. In various embodiments, casing 1105 may be coupled to drill string connector 1600 between male connector 1112 and female connector 116 and forming a flush and continuous outer wall of the drill string connector 1600. In various embodiments, the casing 1105 may be threaded onto drill string connector 1600. In various embodiments, casing 1105 may be slid onto drill string connector 1600 and held in place between the male connector 1112 and female connector 1116, forming a press fit between said connectors. In various embodiments, casing 1105 may have a larger diameter than one or both of male connector 1112 and female connector 1116.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A high pressure fluid drill head for cutting debris to form a bore hole comprising:

a body having an upper end and a lower end, the body having an outflow channel defining a first flow path for returning debris disposed at an axial center extending from the upper end to the lower end of the body;

wherein an outer diameter of the body abuts against the bore hole;

a piston disposed coaxially with the outflow channel within the body, the piston having a top end proximate the upper end of the body and a bottom end proximate the lower end of the body;

at least one pressurized fluid flow channel disposed within the body defining a second flow path of pressurized fluid, the pressurized fluid flow channel disposed parallel to the outflow channel;

a nozzle in fluid communication with the pressurized fluid flow channel, the nozzle having at least one orifice configured for ejecting a fluid;

a return feed inlet disposed at the lower end of the body, the return feed inlet in fluid communication with the outflow channel; and wherein the first flow path of fluid flow through the outflow channel is oriented parallel to the second flow path of pressurized fluid flow.

2. The drill head of claim 1, wherein the piston comprises:

an annular boss disposed proximate the top end, the annular boss circumscribing the piston in a plane perpendicular to the axis of the central channel, the annular boss radially extending at least partially within the pressurized fluid flow channel; and a compression spring engaging the piston, the compression spring extending from the bottom end of the piston to the to a bottom surface of the annular boss.

3. The drill head of claim 2, wherein the piston is configured to translate axially with respect to the drill head body.

4. The drill head of claim 3, wherein the piston is configured to translate axially downward in response to a change in pressure contacting the annular boss.

5. The drill head of claim 3, wherein a convex conical surface of the piston and a concave conical surface of the drill head body form an annular flow channel therebetween, wherein fluid travels within the annular flow channel towards the upper end of the drill head body.

6. The drill head of claim 5, wherein the annular flow channel enlarges as the piston axially translates downward.

7. The drill head of claim 5, wherein the fluid flowing in the outflow channel generates a reduction in pressure at the return feed inlet.

8. The drill head of claim 5, wherein absent fluid pressure, the compression spring is biased to compress the convex conical surface of the piston into the concave conical surface of the drill head body, forming a seal therebetween.

9. The drill head of claim 1, further comprising a plurality of return feed inlets.

10. The drill head of claim 1, further comprising a plurality of nozzles in fluid communication with the at least one pressurized fluid flow channel, wherein the plurality of nozzles disposed radially outward of the outflow channel at a distal end of the drill head.

11. The drill head of claim 1, wherein the pressurized fluid flow channel is an annular channel, the annular channel circumscribing and extending parallel to the outflow channel and the piston.

12. The drill head of claim 1, further comprising a plurality of the pressurized fluid flow channels radially disposed about the outflow channel and parallel thereto.

13. The drill head of claim 1, further comprising a drill casing terminator rotatably coupled thereto, the drill casing terminator having a cylindrical inner wall circumscribing the drill head body and a cylindrical outer wall disposed concentrically with the cylindrical inner wall, the drill casing terminator forming an interior volume proximate the lower end of the drill body, the interior volume having a circular opening.

14. The drill head of claim 13, wherein the drill casing terminator comprising threads configured to be coupled to corresponding threads on a drill casing, the drill casing configured to circumscribe the drill head.

15. The drill head of claim 14, further comprising a drill string connector, the drill string connector coupled to the upper end of the drill head body.

16. The drill head of claim 15, wherein the drill string connector comprises:

an inner tube having a first end and a second end, the inner tube extending coaxially with the outflow channel, the inner tube in fluid communication with the outflow channel;

an outer tube coupled coaxially and concentrically with the inner tube, the outer tube circumscribing the inner tube forming an annular channel therebetween, the annular channel in fluid communication with the pressurized fluid flow channel;

a male connector coupled to the first end of the inner tube and the first end of the outer tube; and a female connector coupled to the second end of the inner tube and the second end of the outer tube.

17. The drill head of claim 15, wherein a plurality of drill connectors are coupled in series to the drill head body.

18. The drill head of claim 1, wherein the nozzle has a plurality of branched orifices fed by a single fluid conduit in fluid communication with the pressurized fluid flow channel.

19. The drill head of claim 1, wherein the nozzle having at least one orifice configured for ejecting a fluid at an angle to the axial center.

* * * * *